US009201375B2

(12) United States Patent
Komatsuzaki et al.

(10) Patent No.: US 9,201,375 B2
(45) Date of Patent: Dec. 1, 2015

(54) IMAGE FORMING APPARATUS

(71) Applicant: FUJI XEROX CO., LTD., Tokyo (JP)

(72) Inventors: Kazunari Komatsuzaki, Kanagawa (JP); Nobuhiro Katsuta, Kanagawa (JP); Yasushi Kawahata, Kanagawa (JP); Satoshi Tatsuura, Kanagawa (JP); Yutaka Nogami, Kanagawa (JP); Keitaro Mori, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/630,064

(22) Filed: Feb. 24, 2015

(65) Prior Publication Data

US 2015/0268613 A1 Sep. 24, 2015

(30) Foreign Application Priority Data

Mar. 20, 2014 (JP) ..... 2014-058048
Sep. 17, 2014 (JP) ..... 2014-189435

(51) Int. Cl.
*G03G 15/00* (2006.01)

(52) U.S. Cl.
CPC ..... *G03G 15/6585* (2013.01)

(58) Field of Classification Search
CPC combination set(s) only.
See application file for complete search history.

(56) References Cited

U.S. PATENT DOCUMENTS

2002/0064403 A1* 5/2002 Sakai et al. ..... 399/309
2002/0159801 A1* 10/2002 Nakashima et al. ..... 399/307
2005/0271408 A1* 12/2005 Hayashi ..... 399/70
2008/0034996 A1* 2/2008 Yamamoto ..... 101/225

FOREIGN PATENT DOCUMENTS

JP H04-114185 A 4/1992
JP 2001-201971 A 7/2001
JP 2003-098864 A 4/2003
JP 2003-167456 A 6/2003
JP 2004-012580 A 1/2004
JP 2004-020715 A 1/2004

* cited by examiner

*Primary Examiner* — Clayton E Laballe
*Assistant Examiner* — Jas Sanghera
(74) *Attorney, Agent, or Firm* — Oliff PLC

(57) ABSTRACT

Provided is an image forming apparatus including a first image forming unit that forms a first image on a front surface of a transported medium with a developer including toners and non-volatile oils, a removing unit that heats non-volatile oils on the front surface of the medium to remove the oils, a second image forming unit that forms a second image on a back surface of the medium with a developer including toners and non-volatile oils, a removing section that heats non-volatile oils on the back surface of the medium to remove the oils, and a fixing unit that fixes the first image and the second image on the front surface and the back surface of the medium.

20 Claims, 14 Drawing Sheets

COMPARATIVE EXAMPLE 1 (60° GLOSS OF FIRST IMAGE AND SECOND IMAGE IN RESPECTIVE POSITIONS)

EXAMPLE 1 (60° GLOSS OF FIRST IMAGE AND SECOND IMAGE IN RESPECTIVE POSITIONS)

EXAMPLE 2 (TEST 2-1, RELATIONSHIP BETWEEN TONER TEMPERATURE OF TONER T AND VISCOSITY OF TONER T)

EXAMPLE 2 (TEST 2-2, RELATIONSHIP BETWEEN TONER TEMPERATURE OF TONER T AND 60° GLOSS)

EXAMPLE 2 (TEST 2-3, RELATIONSHIP BETWEEN VISCOSITY OF TONER T AND 60° GLOSS)

EXAMPLE 2 (TEST 2-4, 60° GLOSS OF FIRST IMAGE AND SECOND IMAGE IN RESPECTIVE POSITIONS)

IMAGE FORMING APPARATUS

CROSS-REFERENCE TO RELATED APPLICATIONS

This application is based on and claims priority under 35 USC 119 from Japanese Patent Application Nos. 2014-058048 filed Mar. 20, 2014 and 2014-189435 filed Sep. 17, 2014.

BACKGROUND

Technical Field

The present invention relates to an image forming apparatus.

SUMMARY

According to an aspect of the invention, there is provided an image forming apparatus including:

a first, image forming unit, that forms a first image on a front surface of a transported medium with a developer including toners and non-volatile oils;

a removing unit that is disposed on a downstream side of the first image forming unit in a transport direction of the medium, and heats non-volatile oils on the front surface of the medium to remove the oils;

a second image forming unit that is disposed on a downstream side of the removing unit in the transport direction, and forms a second image on a back surface of the medium with a developer including toners and non-volatile oils;

a removing section that is disposed on a downstream side of the second image forming unit in the transport direction of the medium, and heats non-volatile oils on the back surface of the medium to remove the oils; and a fixing unit that is disposed on a downstream side of the removing section in the transport direction, and fixes the first imago and the second image on the front surface and the back surface of the medium.

BRIEF DESCRIPTION OF THE DRAWINGS

Exemplary embodiments of the present invention will be described in detail based on the following figures, wherein:

FIGS. 2A and 2D are diagrams showing states of a medium and a developer transported to a first heating unit constituting the image forming apparatus according to the second exemplary embodiment, of which FIG. 2A is a schematic diagram (cross-sectional view) showing the states of the medium and a toner image immediately after the toner image is formed on the medium in a first image forming unit, and FIGS. 2B to 2D are schematic diagrams (cross-sectional views) showing changes of the medium and the developer before the medium is transported to a first, oil removing unit by heating toners constituting the toner image on the medium to be equal to or greater than a melting temperature in the first heating unit;

FIGS. 3A and 3B show the configuration of the image forming apparatus according to the second exemplary embodiment, of which FIG. 3A is a schematic diagram (front view) showing the configuration of the first oil removing unit, and FIG. 3B is a schematic diagram, (front view) showing the configuration of a second oil removing unit;

FIGS. 4A and 4B show the configuration of an image forming apparatus according to a third exemplary embodiment, of which FIG. 4A is a schematic diagram (front view) showing the configuration of a first oil removing unit, and FIG. 4B is a schematic diagram (front view) showing the configuration of a second oil removing unit;

FIGS. 5A and 5B show the configuration of an image forming apparatus according to a fourth exemplary embodiment, of which FIG. 5A is a schematic diagram (front view) showing the configuration of a first oil removing unit, and FIG. 5B is a schematic diagram (front view) showing the configuration of a second oil removing unit;

FIGS. 6A and 6B show the configuration, of an image forming apparatus according to a reference example, of which FIG. 6A is a schematic diagram (front view) showing the configuration of a first oil removing unit, and FIG. 5B is a schematic diagram (front view) showing the configuration of a second oil removing unit;

FIGS. 17A and 17B show the configuration of an image forming apparatus according to a fifth exemplary embodiment, of which FIG. 17A is a schematic diagram (front view) showing the configuration of a first oil removing unit, and FIG. 17B is a schematic diagram (front view) showing the configuration of a second oil removing unit.

DETAILED DESCRIPTION

Outline

Hereinafter, image forming apparatuses according to exemplary embodiments will be described with reference to the drawings. The entire configuration and operation of an image forming apparatus according to a first exemplary embodiment will be initially described. Subsequently, the configurations and effects of second to fifth exemplary embodiments will be described. Thereafter, reference examples will be described. Subsequently, examples will be described.

First Exemplary Embodiment

Entire Configuration of Image Forming Apparatus

Figure 13:
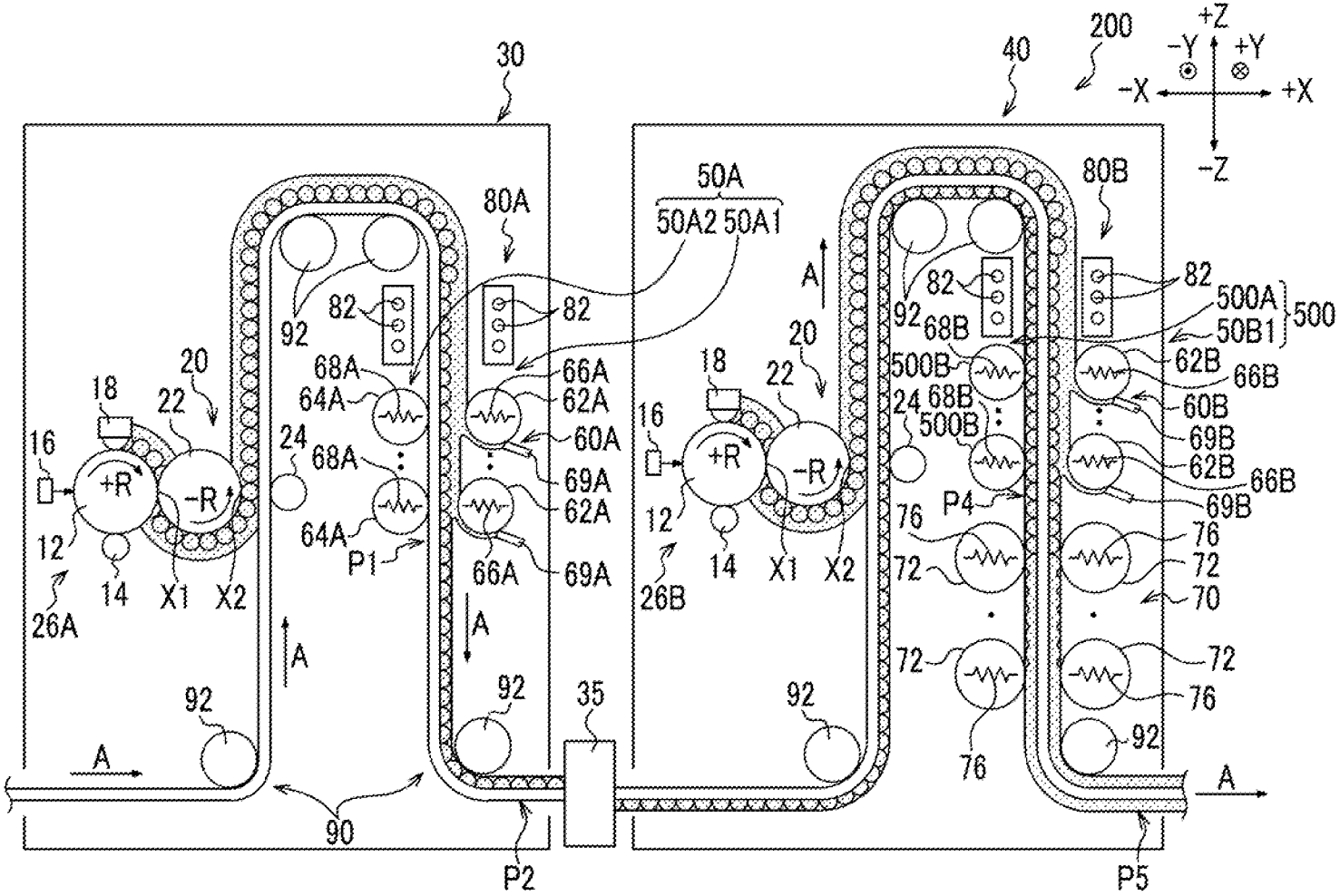
FIG. 13 is a schematic diagram (front view) of an image forming apparatus according to a first exemplary embodiment.

Hereinafter, an image forming apparatus 200 according to the present exemplary embodiment will be described with reference to FIG. 13.

In the following description, it is assumed that a direction represented by arrow Z in FIG. 13 indicates a height direction of the apparatus, and a direction represented by arrow X in FIG. 13 indicates a width direction of the apparatus. Further, it is assumed that a direction (represented by Y) perpendicular to the apparatus height direction and the apparatus width direction is a depth direction of the apparatus. When the image forming apparatus 200 is viewed from a front side, the apparatus height direction, the apparatus width direction and the apparatus depth direction are respectively described as a Z direction, an X direction and a Y direction.

When it is necessary to distinguish one side of the X direction, the Y direction or the Z direction from the other side thereof, in a front view of the image forming apparatus 200, an upper side is described as a +Z side, a lower side is described as a −2 side, a right side is described as a +X side, a left side is described as a −X side, a back side is described as a +Y side, and a front side is described as a −Y side.

The image forming apparatus 200 according to the present exemplary embodiment includes a transport device 90, a first image forming device 30, an inversion device 35, and a second image forming device 400. Operations of the respective components of the image forming apparatus 200 are controlled by a control device (not shown).

Transport Device

The transport device 90 has a function of transporting a medium P in an arrow A direction (transport direction) in the drawing at a predetermined transport speed. The transport device 90 includes plural transport rolls 92. The medium P is, for example, a continuous sheet. The transport device 90 transports the medium P such that the medium P wound around the plural transport rolls 92 passes through the first image forming device 30, the inversion device 35 and the respective components of the second image forming device 400. For example, the transport speed, of the present exemplary embodiment is 60 m/min. In the present exemplary embodiment, as an example of the medium P, OK topcoat+ (registered trademark) (manufactured by Oji Paper Co., Ltd.) is used.

First Image Forming Device

The first image forming device 30 has a function of forming a toner image on one surface (front surface) of the medium P transported by the transport device 90 and a function of removing a portion of non-volatile oils O from the front surface of the medium P. The first image forming device 30 includes a first image forming unit 26A, a first heating unit 80A, a first oil removing unit 50A, and a part of the plural transport rolls 92. Here, the first oil removing unit 50A is an example of a first removing unit.

First Image Forming Unit

The first image forming unit 26A has a function of forming a toner image by a developer including toners T and non-volatile oils O on the front surface of the medium P transported by the transport device 90. The first image forming unit 26A includes a photoconductor drum 12, a charge unit 14, an exposure unit 16, a developing unit 18, and a transfer unit 20. Here, the toner image formed on the front surface of the medium P by the first image forming unit 26A is an example of a first image.

The charge unit 14, the exposure unit 16 and the developing unit 18 are sequentially arranged near the photoconductor drum 12 in a 4-R direction (rotational direction of the photoconductor drum 12).

Photoconductor Drum

The photoconductor drum 12 has a function of holding the toner image developed by the developing unit 18. The photoconductor drum. 12 is formed in a cylindrical shape, and is rotated about its axis (arrow +R direction (clockwise direction)) by a driving section (not shown). The photoconductor drum 12 includes an aluminum base and a photosensitive layer (not shown) obtained by sequentially forming an under coat layer, a charge generation layer and a charge transport layer on the base.

Charge Unit

The charge unit 14 has a function of charging an outer circumferential surface of the photoconductor drum 12. The charge unit 14 is disposed in an axial direction (Y direction) of the photoconductor drum 12. In the present exemplary embodiment, the charge unit 14 is a charge roll.

Exposure Unit

The exposure unit 16 has a function of forming a latent image on the cuter circumferential surface of the photoconductor drum 12 charged by the charge unit 14. The exposure unit 16 emits exposure light from a light emitting diode array (not shown) based on image data, received from an image signal processing unit (not shown). The outer circumferential surface of the photoconductor drum 12 charged by the charge unit 14 is irradiated with the exposure light, and thus, the latent image is formed on the outer circumferential surface.

Developing Unit

The developing unit 18 has a function of developing the latent image formed on the photoconductor drum 12 as a toner image with the developer including the toners T and the non-volatile oils O. The developing unit 18 is disposed in the axial direction (Y direction) of the photoconductor drum 12.

Transfer Unit

The transfer unit 20 has a function of secondarily transferring the toner image which is primarily transferred from the photoconductor drum 12 on the transported medium P. The transfer unit 20 includes an intermediate transfer roll 22, and a backup roll 24.

Intermediate Transfer Roll

The intermediate transfer roll 22 comes in contact with the photoconductor drum 12 in a primary transfer position X1 which is on an upstream side of the charge unit 14 and is on a downstream side of the developing unit 16 in the rotational direction of the photoconductor drum 12, and is driven-rotated in a direction (counterclockwise direction) represented by an arrow −R. Thus, the transfer unit 20 primarily transfers the toner image formed on the outer circumferential surface of the photoconductor drum 12 onto the intermediate transfer roll 22 in the primary transfer position X. A primary transfer voltage is applied between the photoconductor drum 12 and the intermediate transfer roll 22 by a power supply (not shown). The toner image is primarily transferred onto the medium P, and thus, the non-volatile oils O are also moved onto the medium P.

Backup Roll

The backup roll 24 is disposed on an opposite side to the photoconductor drum 12 to face the intermediate transfer roll 22. A nip portion is formed by the backup roll 24 and the intermediate transfer roll 22, and the backup roll is driven-rotated in a direction represented by an arrow +R by the rotation of the intermediate transfer roll 22. Here, a position where the intermediate transfer roll 22 and the medium P come in contact with each other is a secondary transfer position X2, and the toner image which is primarily transferred onto the intermediate transfer roll 22 is secondarily transferred onto the medium P in the secondary transfer position X2. A secondary transfer voltage is applied between the intermediate transfer roll 22 and the backing roll 24. The toner image is secondarily transferred onto the medium P, and thus, the non-volatile oils O are also moved to the medium P.

First Heating Unit

The first heating unit 80A has a function of heating the toners T constituting the toner image on the front surface of the medium P to be equal to or greater than, a melting temperature of the toners T. In the present exemplary embodiment, the first heating unit 80A includes, for example, plural infrared heaters 82. The plural infrared heaters 82 are arranged in a row on the front surface of the medium P. Similarly, the plural infrared heaters 82 are arranged in a row on a hack surface of the medium P. The plural infrared heaters 82 that are respectively arranged on the front surface and the back surface of the medium P are arranged in positions where the heaters do not come in contact with the medium P with the medium P interposed therebetween.

When the toners T constituting the toner image on the front surface of the medium P are heated to be equal to or greater than a melting temperature of the toners T by the first heating unit 80A, two layers in which a layer formed by melting the toners T and an oil layer are sequentially separated are formed on the front surface of the medium P. Such a mechanism will be described below.

Definition of Melting Temperature of Toner and Measuring Method

The melting temperature of the toners T indicates a temperature of a top portion of a heat, absorbing peak (main, member maximum, peak) obtained by performing the following measurement. The melting temperature of the toners T is measured using a DSC measuring instrument (differential scanning calorimeter DSC-7 manufactured by PerkinElraer Co., Ltd.) according to ASTMD 3418-8. A temperature of a detection unit of the DSC measuring instrument is corrected using the melting temperature of indium and zinc, and a heat amount thereof is corrected using the fusion heat of indium. The melting temperature of the toners T is measured at a temperature rising rate of 10° C./rain by using an aluminum pan and setting an empty pan to a target. In the present exemplary embodiment, the melting temperature of the toners T is, for example, 110° C.

First Oil Removing Unit

The first oil removing unit 50A has a function of heating the non-volatile oils O on the front surface of the medium P to remove the oil. Here, the first oil removing unit 50A is an example of a removing unit. The first oil removing unit 50A is disposed on a downstream side of the first image forming unit 26A in the transport direction of the medium P.

Figure 3A:
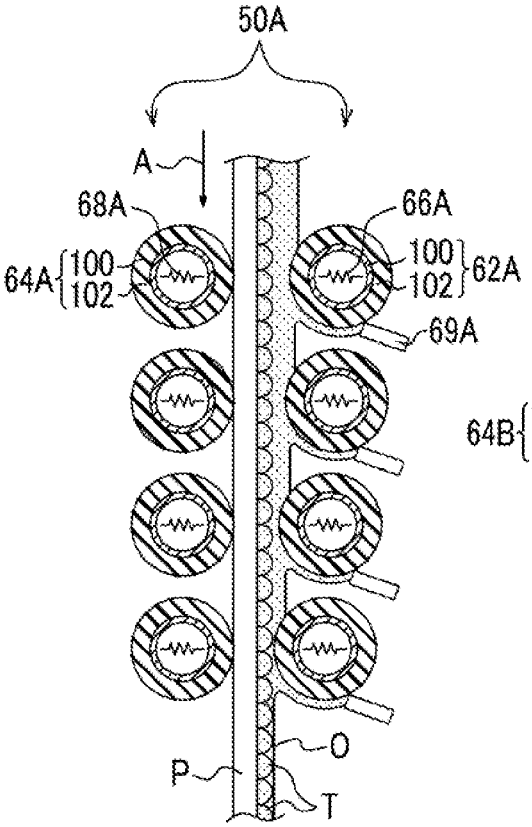
Figure 3B:
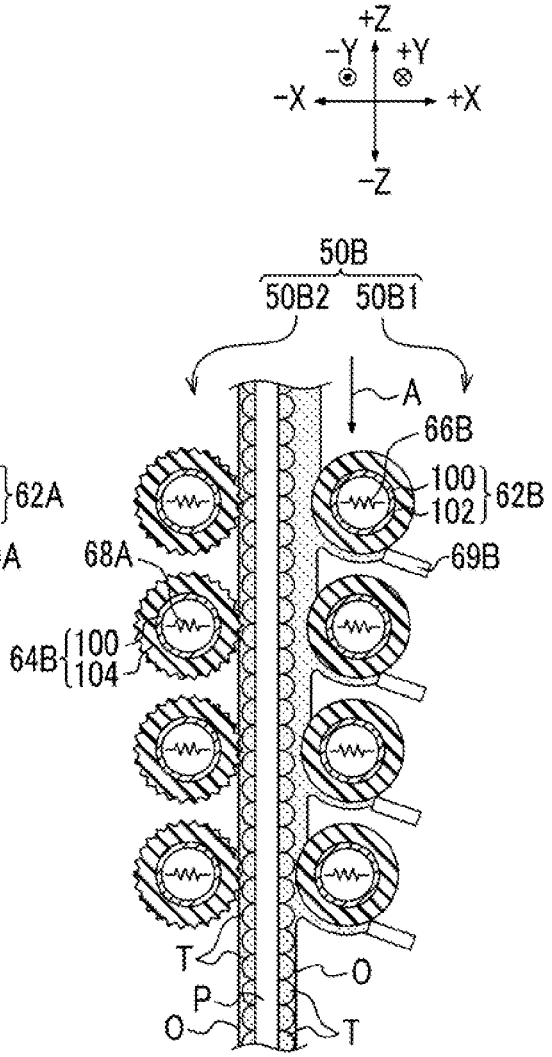

The first oil removing unit 50A includes an oil removing roll 62A, a press roll 64A, a halogen heater 66A, a halogen heater 68A, and a recovery blade 69A (see FIGS. 3A and 3B).

The oil removing roll 62A has a function of rotating while coming in contact with the non-volatile oils O on the front surface of the transported medium P. The oil removing roll 62A includes a cylindrical member 100, and an elastic member 102. The elastic member 102 is fixed by being bonded to the entire outer circumferential surface of the cylindrical member 100. The halogen heater 66A is disposed inside the cylindrical member 109. An outer circumferential surface of the oil removing roll 62A (elastic member 102) is heated to, for example, 120° C. by the halogen beater 66A. The elastic member 102 constituting the oil removing roll 62A presses against the toner image and the oils O on the front surface of the medium P while being depressed.

The recovery blade 69A has a function of recovering the non-volatile oils O moved to the outer circumferential surface of the oil removing roll 62A by coming in contact with the outer circumferential surface of the oil removing roll 62A. Thus, the first oil removing unit 50A removes the non-volatile oils O on the front surface of the medium P.

The press roll 64A is disposed to face the oil removing roll 62A with the transported medium P interposed therebetween, and has a function of pressing against the oil removing roll 62A. The press roll 64A has the same configuration as that of the oil removing roll 62A. The halogen heater 68A is disposed inside the cylindrical member 100. An outer circumferential surface of the press roll 64A (elastic member 102) is heated to, for example, 120° C. by the halogen heater 68A.

The first oil removing unit 50A is provided as plural first oil removing units 50A arranged in the transport direction of the medium P. The medium P passes through the first oil removing units 50A at a speed of, for example, 8 ms. The oil removing roll 62A pressurizes the medium P interposed between the oil removing roll 62A and the press roll 64A at a pressure of, for example, 2.8 kg/cm$^2$.

Inversion Device

The inversion device 35 has a function of inverting the front surface and the back surface of the medium P sent from the first image forming device 30 by the transport device 90. The medium P whose front and back surfaces are inverted, by the inversion device 35 is sent to the second image forming device 400 by the transport device 90.

Second Image Forming Device

The second image forming device 400 has a function of forming the toner image on the back surface of the medium P, a function of removing a portion of the oils O from the back surface of the medium P, and a function of fixing the toner images formed on the front surface and the back surface of the medium P. The second image forming device 400 includes a second image forming unit 26B, a second heating unit 80B, a second oil removing unit 500, a fixing unit 70, and a part of the plural transport rolls 92.

Second Image Forming Unit

The second image forming unit 26B has a function of forming a toner image with a developer including toners T and non-volatile oils O on the back surface of the medium P transported by the transport device 90. Similarly to the first image forming unit 26A, the second image forming unit 20B includes the photoconductor drum 12, the charge unit 14, the exposure unit 16, the developing unit 18, and the transfer unit 20. The second image forming unit 26B has the same configuration as that of the first image forming unit 26A except for the arrangement of the first image forming unit. The second image forming unit 26B is disposed on a downstream side of the first oil removing unit 50A in the transport direction of the medium P. Here, the toner image formed on the back surface of the medium P by the second image forming unit 26S is an example of a second image.

Second Heating Unit

The second heating unit 80B has a function of heating the toners T constituting the toner image on the back surface of the medium P to be equal to or greater then a melting temperature of the toners T. The second heating unit 80B has the same configuration as that of the first heating unit 80A except for the arrangement of the first heating unit. When the toners T constituting the toner image on the back surface of the medium P are heated to be equal to or greater than the melting temperature of the toners T by the second heating unit 80B, two layers in which a layer obtained by melting the toners T and an oil layer are sequentially separated are formed on the back surface of the medium P.

Second Oil Removing Unit

The second oil removing unit 500 has a function of heating the oils O on the back surface of the medium P to remove the oil. The second oil removing unit 500 is disposed on an upstream side of the fixing unit 70 and a downstream side of the second image forming unit 26B in the transport direction of the medium P.

Figure 5A:
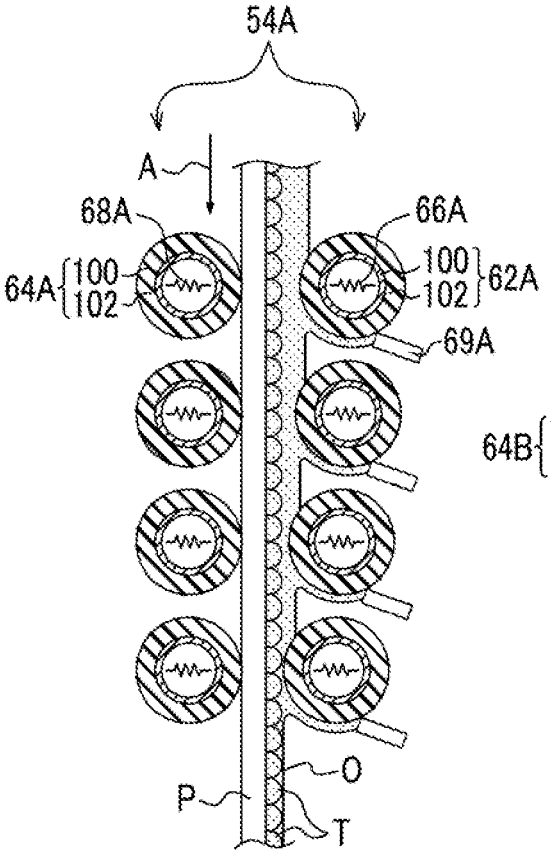
Figure 5B:
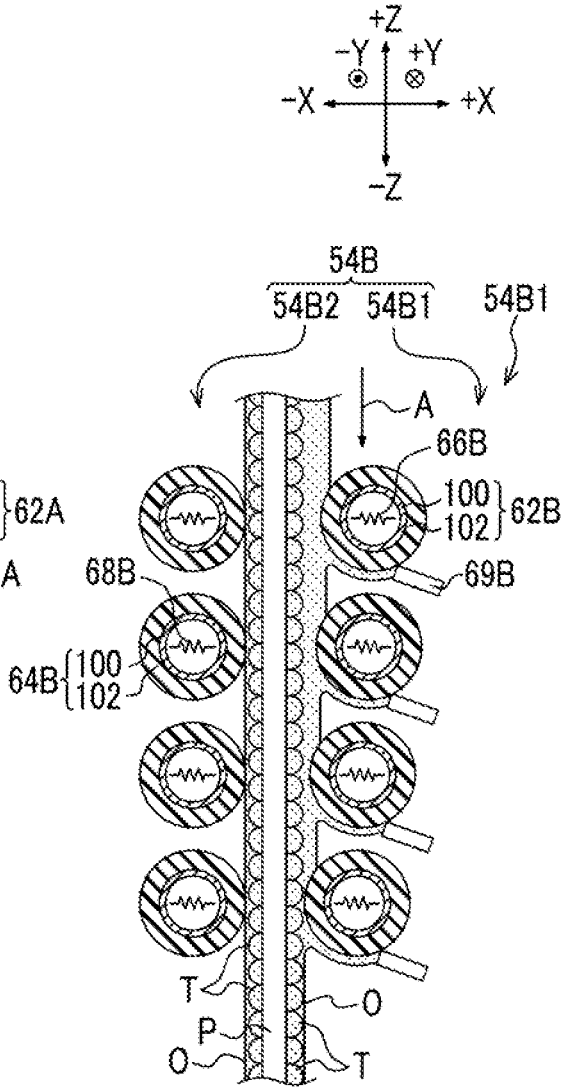
Figure 17A:
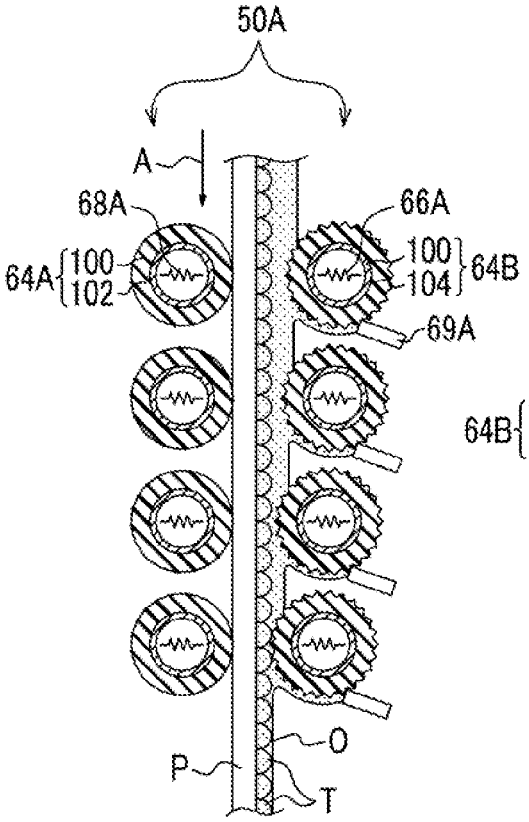
Figure 17B:
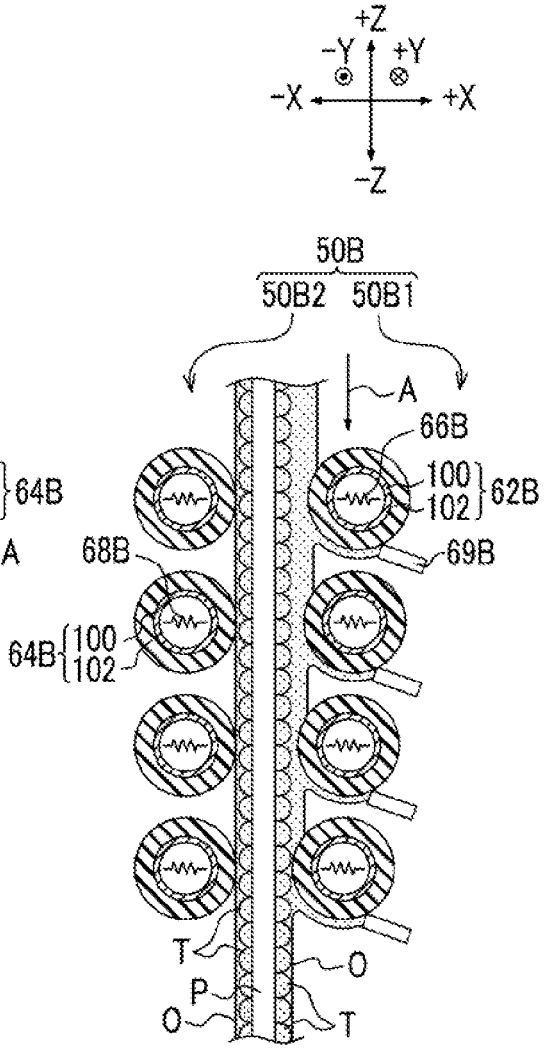

The second oil removing unit 500 includes an oil removing unit 50B1, a press unit 500A, and a halogen heater 68B (see FIG. 5B and FIG. 17B. Here, the oil removing unit 50B1 is an example of a removing section.

Oil Removing Unit

The oil removing unit 50B1 includes an oil removing roll 62B, a halogen heater 66B, and a recovery blade 69B. The oil removing roll 62B has the same configuration as that of the oil removing roll 62A. The halogen heater 66B is disposed inside the cylindrical member 100. An outer circumferential surface of the oil removing roll 62B (elastic member 102) is heated to, for example, 120° C. by the halogen heater 66B. The elastic member 102 constituting the oil removing roll 62B presses against the toner image and the oils O on the back surface of the medium P while being depressed. In other words, an outer circumferential portion of the oil removing roll 62B, that is, a portion coming in contact with the toner image formed on the back surface of the medium P by the second image forming unit 26B is formed as an elastic layer (elastic member 102). Here, the halogen heater 66B is an example of a heating section.

The recovery blade 69B has a function of recovering the oils O moved to the outer circumferential surface of the oil removing roll 62B by coming in contact with, the outer circumferential surface of the oil removing roll 62B.

The press unit 500A includes plural press rolls 500B. The press rolls 500B are arranged to face the oil removing roll 62B with the transported medium P interposed therebetween, and have a function of pressing against the oil removing roll 62B. The press roll 500B has the same configuration as that of the oil removing roll 62B. The halogen heater 68B is disposed inside the cylindrical member 100. An outer circumferential surface of the press roll 500B (elastic member 102) is heated to, for example, 120° C. by the halogen heater 68B.

The second oil removing unit 500 is provided as plural second oil removing units 500 arranged in the transport direction of the medium P. The medium P passes through the second oil removing units 500 at a speed of, for example, 8 ms. The oil removing roll 62B pressurizes the medium P interposed between the oil removing roll 62B and the press roll 64B at a pressure of, for example, 275 kPa.

Gloss (Glossiness)

Here, the glossiness refers to an amount indicating a degree of brightness of an object when a person sees the object as a result of applying light to a surface of the object to be reflected from the object. According to the standard (JIS standard) of the glossiness, when an incident angle of light on a glass surface having a refractive index of 1.567 is 60% a case where a reflectivity of the incident light is 10% indicates a glossiness of 100 (or 100%). In the following description, a 60° gloss refers to a glossiness when an incident angle of light is 60°.

Fixing Unit

The fixing unit 70 has a function of respectively fixing the toner images formed on the front surface and the back surface of the medium P on the front surface and the back surface of the medium P. The fixing unit 70 includes plural fixing rolls 72, and plural halogen heaters 76. The fixing rolls 72 have a cylindrical shape. The halogen heater 76 is disposed inside the fixing roll 72, and has a function of heating the fixing roll 72. In the fixing unit 70 of the present exemplary embodiment, three pairs of fixing rolls 72 are arranged in the apparatus height direction such that the fixing rolls each including the halogen heater 76 therein are paired with the medium P interposed therebetween. The fixing unit 70 is disposed on a downstream side of a second oil removing unit 50B in the transport direction of the medium P. Here, the fixing unit 70 is art example of a fixing section.

The pair of fixing rolls 72 forms nip portions on the front surface and the back surface of the transported medium P. The pair of fixing rolls 72 pressurises the medium P at a pressure of, for example, 275 kPa.

When the fixing roll 72 is driven by a driving source and is heated by the halogen heater 76, the fixing roll is rotated while being heated. The fixing unit 70 fixes the toner images on the front surface and the back surface of the medium P passing through the nip portions on the medium P.

The fixing roll 72 is heated to, for example, 120° C. by being heated by the halogen heater 76. The medium P passes through the nip portions at a speed of, for example, 12 ms. As mentioned above, the fixing unit 70 applies a heat amount greater than those of the first heating unit 80A, the first oil removing unit 50A, the second heating unit 80B and the second oil removing unit 500 to the toners T on the medium P.

Developer

Figure 2A:
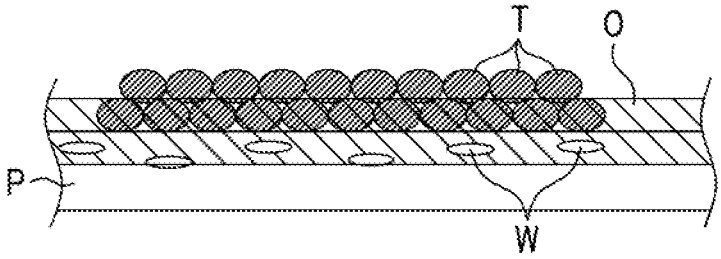

The developer used in the present exemplary embodiment is a liquid type developer (liquid developer) obtained by dispersing powder toners T (see FIG. 2A) in the oils O (see FIG. 2A). In the present exemplary embodiment, the toners T include, for example, a non-crystalline polyester resin, a crystalline polyester resin, a pigment, and a paraffin wax. Among the components of the toners T, the non-crystalline polyester resin is a main component. The oil O is, for example, a silicone oil (KF-96-20cs manufactured by Shin-Etsu Chemical Co., Ltd.). Here, the silicone oil is an example of the non-volatile oil. An average particle diameter of the toners T is from 3 μm to 6 μm. The toners T do not enter the inside of the medium P at a normal temperature. In contrast, since the oils O are liquids, the oils enter the inside of the medium P even at a normal temperature.

Non-Volatility

Here, the non-volatility means that a volatile component is equal to or less than 8% by weight after 24 hours at a flash point of 130° C. or more or 150° C.

Difference Between SP Values of Toner and Non-Volatile Oil

In the present exemplary embodiment, a difference between SP values of the toners T and the oils O ranges from 1.5 to 7.0.

Calculating Method of SP Value

The SP value is the square root of density of cohesive energy, and in the present exemplary embodiment, the SP values ox the toners T and the oils O are obtained by the following method.

The SP values are obtained by an estimation method of Van Kreveren and Hoftyzer. In this method, according to a hypothesis in which a cohesive energy density depends on the kind and number of substituents, the SP value of a polymer is calculated in units of segment based on a cohesive energy value determined for each substituent. A value obtained by dividing the cohesive energy calculated by this method by the molar volume of a substance and calculating the square root of the resultant value is the SP value (reference literature: SP Value Basics/Applications and Calculation Method, written by Hideki YAMAMOTO, JOHOKIKO CO., Ltd., 2005).

In general, the SP value obtained by this method has a unit of $cal^{1/2}/cm^{3/2}$, and is described as dimensionless. In addition, since a relative difference between two compounds has significance in the present specification, the value obtained according to the aforementioned general method is used, and the obtained value is described in dimensionless in the present specification. For reference, when the SP value obtained by this method is described in terms of SI units ($J^{1/2}/m^{3/2}$), the SP value obtained by this method may be multiplied by 2046.

Operation of Image Forming Apparatus

In the image forming apparatus 200, an image is formed as follows.

In the image forming unit 26A constituting the first image forming device 30, the photoconductor drum 12 rotates, and the cater circumferential surface of the photoconductor drum 12 is charged by the charge unit 14. Subsequently, the charged outer circumferential surface of the photoconductor drum 12 is exposed by the exposure unit 16, and thus, an electrostatic latent image (not shown) is formed on the outer circumferential surface of the photoconductor drum 12. The electrostatic latent image is developed as the toner image by the developing unit 18.

Thereafter, the toner image reaches the primary transfer position X1 by the rotation of the photoconductor drum 12, and is primarily transferred onto the intermediate transfer roll 22 with the primary transfer voltage. In this case, the oils O (see FIG. 2A) are also moved to the intermediate transfer roll 22 together with the toners T. The toner image transferred onto the intermediate transfer roll 22 reaches the secondary transfer position X2 by the rotation of the intermediate transfer roll 22, and is secondarily transferred onto the medium P with the secondary transfer voltage. In this case, the oils O are also moved to the medium P together with the toners T. Thus, the toner image is formed on the front surface of the medium P transported by the transport device 90.

The photoconductor drum 12 in which the primary transfer of the toner image onto the intermediate transfer roll 22 is finished is cleaned by a cleaner (not shown), and the oils O and the like remaining on the cuter circumferential surface of the photoconductor drum 12 are removed. The outer circumferential surface of the intermediate transfer roll 22 in which the secondary transfer of the toner image onto the front surface of the medium P is finished is cleaned by a cleaner (not shown), and the oils O and the like remaining on the outer circumferential surface of the intermediate transfer roll 22 are removed.

Thereafter, the medium P in which the toner image is formed on the front surface is transported by the transport device 90, and reaches the first heating unit 80A. The toners T constituting the toner image on the front surface of the medium P which is secondarily transferred by the image forming unit 26A are heated to be equal to or greater than a melting temperature of the toners T by the first heating unit 80A.

Figure 2B:
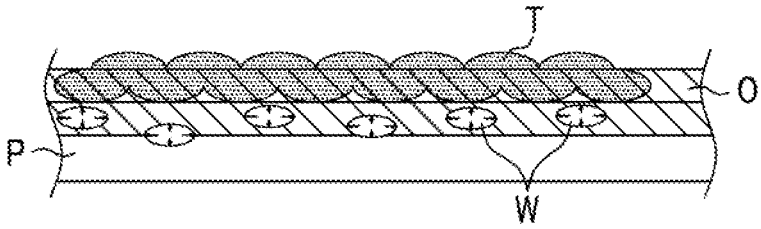
Figure 2C:
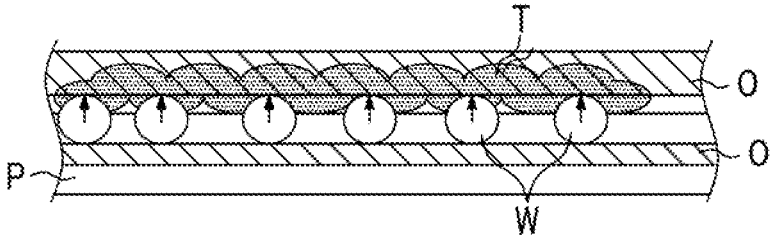
Figure 2D:
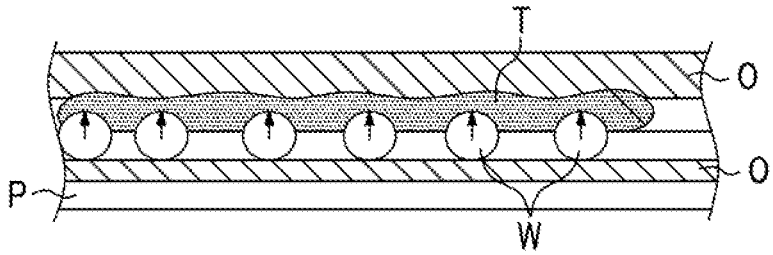

Mechanism in which Two Layers Including Layer Obtained by Melting Toner T and Oil Layer are Formed Here, when the toners T are heated to be equal to or greater than a melting temperature of the toners T by the first heating unit 80A, the toners T secondarily transferred onto the front surface of the medium P and the non-volatile oils O moved to the medium P together with the toners T exhibit the following behaviors. As shown in FIG. 2A, a portion of the non-volatile oils O infiltrates into the medium P. In contrast, the toners T heated to be equal to or greater than the melting temperature by the heating unit 80A change from a solidified state to a melted state, as shown in FIG. 2B. As shown in FIG. 2B, moisture W existing in the medium P starts to vaporize by being heated by the heating unit 80A. Subsequently, the toners T and the non-volatile oils O start to become separated from each other by repelling each other due to a difference between the SP value of the toners T and the SP value of the non-volatile oils O, as shown in FIG. 2C. Since an affinity of the toners T with the medium P is higher than an affinity of the non-volatile oils O with the medium P, the layer obtained by melting the toners T is formed on the medium P as a lower layer, and the oil layer is formed on the layer obtained by melting the toners T as an upper layer. The vaporized moisture W has a function of secondarily pushing the oils O infiltrated into the medium P out of the medium P. In other words, before the medium reaches the first oil removing unit 50A, the toners T secondarily transferred onto the front surface of the medium P from the transfer roll 22 and the non-volatile oils O moved together with the toners T form the two layers in which the layer obtained by melting the toners T and the oil layer are sequentially separated, on the front surface of the medium P. As a result, since the layer obtained by melting the toners T is formed on the front surface of the medium P, it is difficult for the non-volatile oils O constituting the oil layer formed on an outer surface of the layer obtained by melting the toners T to infiltrate into the medium P from the layer obtained by melting the toners T.

As mentioned above, the developer of the present exemplary embodiment includes a non-crystalline polyester resin as a main component of the toners T, and silicone oils as the non-volatile oils. Here, in the image forming apparatus 200 according to the present exemplary embodiment, an image may be formed using a developer (hereinafter, referred to as a comparative developer) including a non-crystalline polyester resin as a main component of the toners T and paraffin-based oils as the non-volatile oils. However, an affinity between a non-crystalline polyester resin and silicone oils is lower than an affinity between a non-crystalline polyester resin and paraffin-based oil. For this reason, when the toners T on the front surface of the medium P is heated to be equal to or greater than a melting temperature of the toners by the first heating unit 80A, it is easy to form two separated layers with the developer according to the present exemplary embodiment in comparison with the comparative developer. Accordingly, when the developer of the present exemplary embodiment is used, it is easy to remove the oils O in the first oil removing unit 50A compared to the case where the comparative developer is used.

The two layers in which the layer obtained by melting the toners T on the front surface of the medium P and the oil layer are sequentially separated are formed, and thus, the toners T constituting the layer obtained by being melted through the heating of the first heating unit 80A have a higher adhesion force to the medium P than that before the toners T are heated.

Here, reference numeral W in FIGS. 2A to 2D denotes moisture existing in the medium P. The toners T adhere to the front surface of the medium P while being substantially laminated one en top of the other as two layers, for example. A state where the toners T are solidified, is depicted as a hatched line, and a state where the toners are melted is depicted as a dotted line. The oils O are depicted as a hatched line having an angle and interval different from those of the toners T.

Thereafter, the medium P is transported by the transport device 90, and reaches the first oil removing unit 50A. A portion of the non-volatile oils O constituting the oil layer on the front surface of the medium P is removed by the first oil removing unit 50A. As stated above, the adhesion force of the toners T to the medium P is increased by being heated by the first heating unit 80A. For this reason, when a portion of the non-volatile oils O is removed by the first oil removing unit 50A, the disturbance of the first image on the front surface of the medium P does not easily occur.

Subsequently, the medium P is transported by the transport device 90, is sent from the first image forming device 30, and reaches the inversion device 35. While the medium P is transported by the transport device 90, the front surface and the back surface of the medium P are inverted by the inversion device 35. Thereafter, the medium P whose front and back surfaces are inverted is sent to the second image forming device 400 by the transport device 90.

Subsequently, the medium P is transported by the transport device 90, and reaches the second image forming unit 26B. In the second image forming unit 26B, the toner image is formed on the back surface of the medium P.

Similarly to the first image forming unit 26A, the photoconductor drum 12 and the intermediate transfer roll 22 constituting the second image forming unit 26B are respectively cleaned by cleaners (not shown).

Thereafter, the medium P in which the toner image is formed on the back surface is transported by the transport device 90, and reaches the second heating unit 80B. The toners T constituting the toner image on the back surface of the medium P which is secondarily transferred by the image forming unit 26B are heated to be equal to or greater than the melting temperature of the toners T by the second heating unit 80B. When the toners T are heated to be equal to or greater than the melting temperature of the toners T by the second heating unit 80B, two layers in which the layer obtained by melting the toners T and the oil layer are sequentially separated are formed on the back surface of the medium P. Such a mechanism is based on the mechanism when the toners T on the front surface of the medium P are heated to be equal to or greater than the melting temperature by the first heating unit 80A.

Subsequently, the medium P is transported by the transport device 90, and reaches the second oil removing unit 500. A portion of the non-volatile oils O constituting the oil layer on the back surface of the medium P is removed by the oil removing unit 50B1 constituting the second oil removing unit 500. The adhesion force of the toners T to the medium P is increased by being heated by the second heating unit 80B. For this reason, when a portion of the non-volatile oils O is removed by the second oil removing unit 500, the disturbance of the second image on the back surface of the medium P does not easily occur.

Subsequently, the medium P is transported by the transport device 90, and reaches the fixing unit 70. The toner images formed on the front surface and the back surface of the medium P are respectively fixed on the front surface and the back surface of the medium P.

When the image is formed on one surface of the medium P, the toner image is formed on, for example, the front surface of the medium P by the first image forming unit 26A, and the intermediate transfer roll 22 and the backup roll 24 of the second image forming unit 26B are separated from the medium P.

Effects of First Exemplary Embodiment

Next, the effects of the present, exemplary embodiment will be described with reference to the drawings. The effects of the present exemplary embodiment will be described by being compared with comparative embodiments (first comparative embodiment and second comparative embodiment) to be assumed below. Subsequently, the effects of the present exemplary embodiment will be described without being compared to the comparative embodiments. In the following description, when the components used in the present exemplary embodiment are used, the effects thereof will be described using the reference numerals of these components. The "toner image formed on the front surface of the medium P by the first forming unit 26A" is referred to as the "first image", and the "toner image formed on the back surface of the medium P by the second, image forming unit 26B" is referred to as the "second image".

Comparison with First Comparative Embodiment

Figure 14:
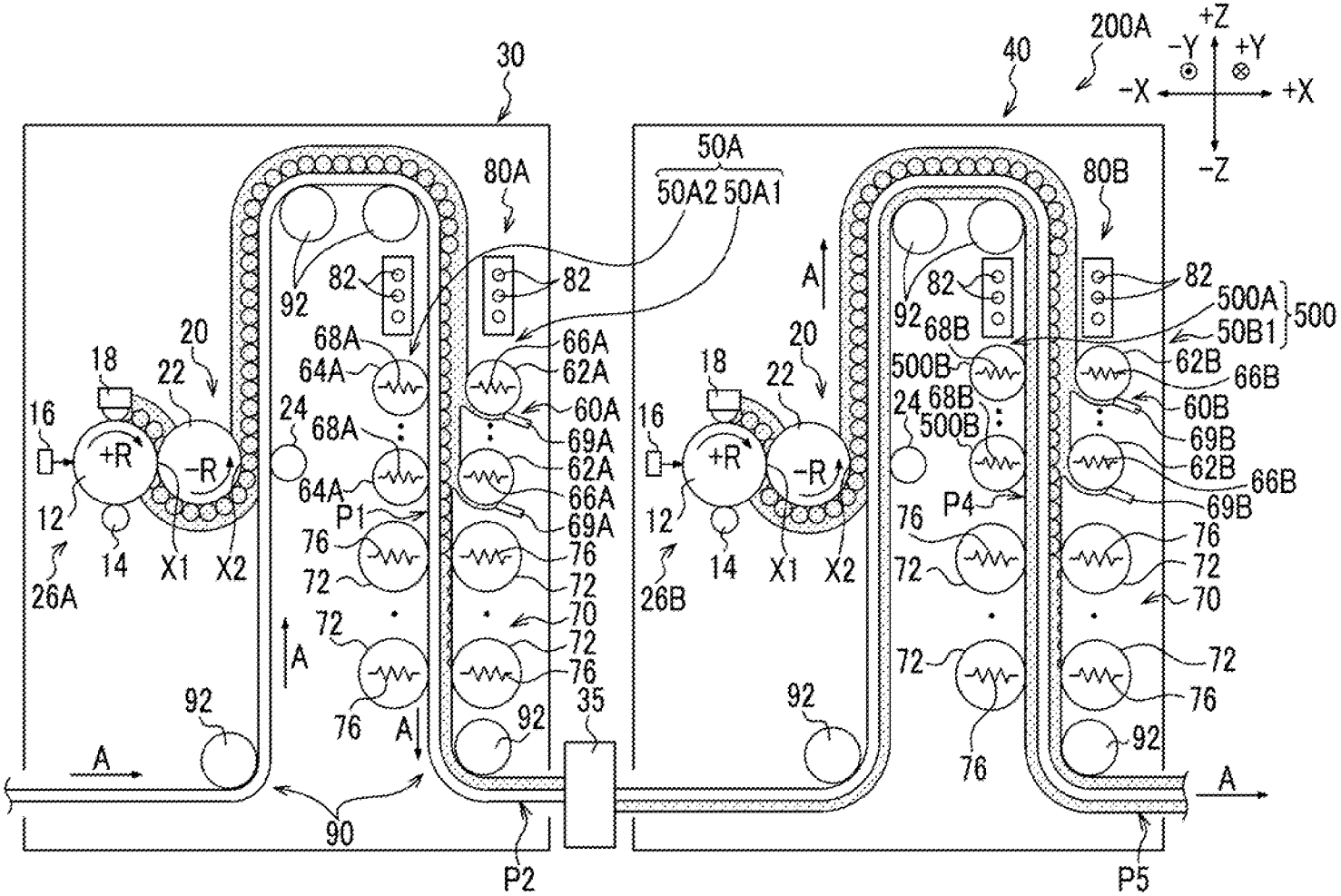
FIG. 14 is a schematic diagram (front view) of an image forming apparatus according to a first comparative embodiment.

As shown in FIG. 14, an image forming apparatus 200A according to a first comparative embodiment includes a first image forming device 300A and a second image forming device 400A. The first image forming device 300A includes the fixing unit 70 on a downstream side of the first oil removing unit 50A in the transport direction of the medium P. The image forming apparatus 200A according to the first comparative embodiment has the same configuration as that of the image forming apparatus 200 according to the first exemplary embodiment except for the aforementioned configuration.

When the image is formed using the image forming apparatus 200A according to the first comparative embodiment, after the first image is fixed on the front surface of the medium P by the first image forming device 300A, the second image is fixed on the back surface of the medium P by the second image forming device 400A. That is, in the image forming apparatus 200A according to the first comparative embodiment, the first image passes through the first heating unit 80A, the first oil removing unit 50A, the fixing unit 70, the second heating unit 80B, the second oil removing unit 500 and the fixing unit. 70, and exits from the second image forming device 40. For this reason, before the toners T constituting the first image exit from the second image forming device 40, the toners are heated to be equal to or greater than a melting temperature of the toners T at six positions.

The second image passes through the second heating unit 80B, the second oil removing unit 500 and the fixing unit 70, and exits from the second image forming device 400A. For this reason, before the toners T constituting the second image exit from the second image forming device 400A, the toners are heated to be equal to or greater than the melting temperature of the toners T at three positions.

As described above, since a degree (degree of melting plural particles of the toners T) of melting the toners T constituting the first image is higher than that of the toners T constituting the second image, the image (hereinafter, referred to as a first fixing image) fixed on the front surface of the medium P has a gloss higher than that of the image (hereinafter, referred to as a second fixing image) fixed on the back surface of the medium P. As a result, a gloss difference occurs between the first fixing image and the second fixing image (see FIG. 15). Here, a position P1 indicates a position on a downstream side of the first oil removing unit 50A and an upstream side of the fixing unit 70 of the first image forming device 300A on a transport path of the medium P. A position P2 indicates a position on a downstream side of the fixing unit 70 of the first image forming device 300A and an upstream side of the inversion device 35 on the transport path of the medium P. A position P4 indicates a position on a downstream side of the second oil removing unit 500 and an upstream side of the fixing unit 70 of the second image forming device 400A on the transport path, of the medium P. A position P5 indicates a position on a downstream side of the fixing unit 70 of the second image forming device 400A.

In contrast, when the image is formed using the image forming apparatus 200 according to the present exemplary embodiment, the first image is formed on the front surface of the medium P by the first image forming device 30, the second image is formed on the back surface of the medium P by the second image forming device 400, and the first image and the second image are fixed on the front surface and the back surface of the medium P. That is, in the image forming apparatus 200 according to the first exemplary embodiment, the first image passes through the first heating unit 80A, the first oil removing unit 50A, the second heating unit 80B, the second oil removing unit 500 and the fixing unit 70, and exits from the second image forming device 400. For this reason, before the toners T constituting the first image exit from the second image forming device 400, the toners are heated to be equal to or greater than the melting temperature of the toners T at five positions.

The second image passes through the second heating unit 80B, the second oil removing unit 50B and the fixing unit 70, and exits from the second image forming device 40. For this reason, before the toners T constituting the second image exit from the second image forming device 40, the toners are heated to be equal to or greater than the melting temperature of the toners T at three positions.

As described above, the fixing unit 70 applies a heat amount greater than those in the first heating unit 80A, the first oil removing unit 50A, the second heating unit 80B and the second oil removing unit 500 to the toners T on the medium P. For this reason, in the first fixing image formed in the image forming apparatus 200 according to the present exemplary embodiment, the number of positions heated to be equal to or greater than the melting temperature of the toners T is smaller than that in the first fixing image formed in the image forming apparatus 200A according to the first comparative embodiment by one position, and there is no portion to which the greatest heat amount is applied.

Figure 15:
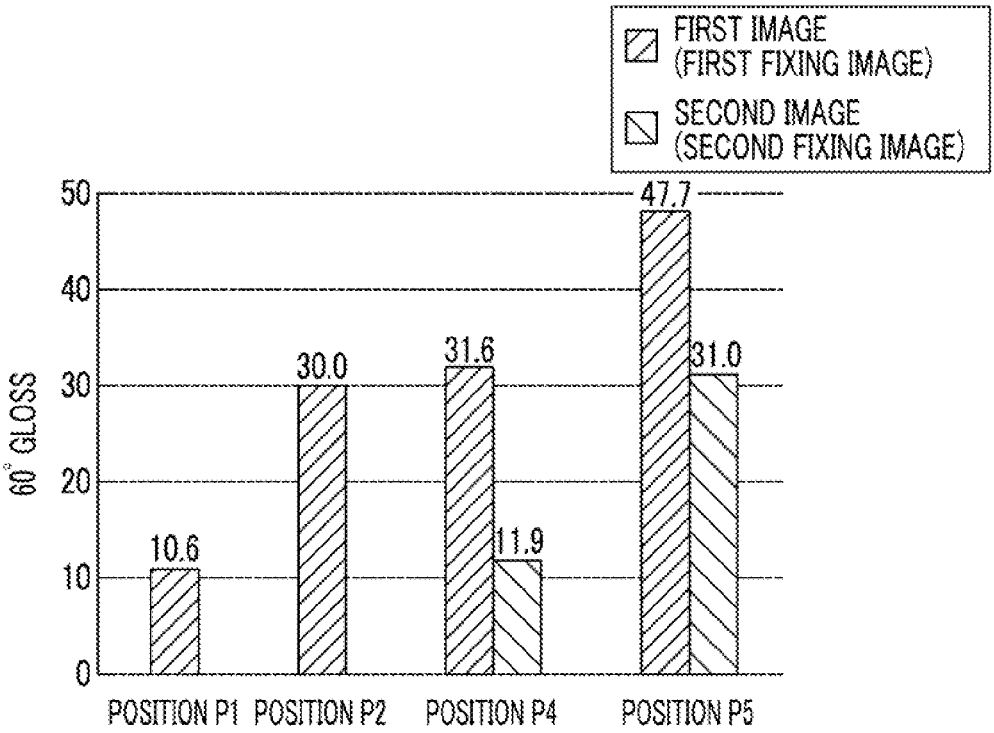
FIG. 15 is a graph showing the test result (measured result of the 60° gloss in the respective positions) of the first comparative embodiment.
Figure 16:
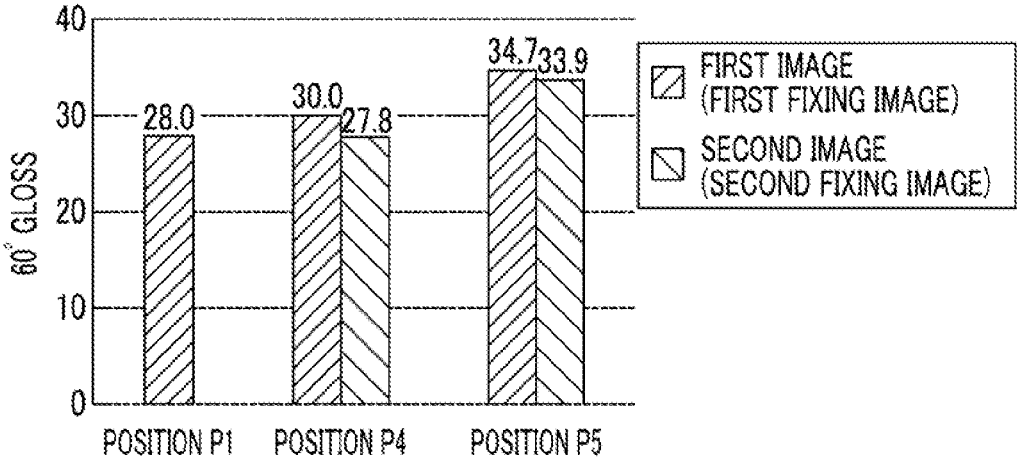
FIG. 16 is a graph showing the test result (measured result of the 60° gloss in the respective positions) of the first exemplary embodiment.

Therefore, in accordance with the image forming apparatus 200 according to the present exemplary embodiment, a gloss difference between the first fixing image and the second fixing image is smaller than that in the image forming apparatus 200A according to a second comparative embodiment (see FIGS. 15 and 16). A position D indicates a position on a downstream side of the first oil removing unit 50A and an upstream side of the inversion device 35 on the transport path of the medium P. A position E indicates a position on a downstream side of the second oil removing unit 500 and an upstream side of the fixing unit 70 on the transport path of the medium P.

Comparison with Second Comparative Embodiment

Non-volatile oils used in the second comparative embodiment are different from those used in the present exemplary embodiment. For this reason, in the second comparative embodiment, a difference between SP values of toners T and non-volatile oils does not fall within a range of from 1.5 to 7.0. The second comparative embodiment has the same configuration as that of the present exemplary embodiment except for the aforementioned difference.

In the image forming apparatus according to the second comparative embodiment, when the difference between the SP values of the toners T and the non-volatile oils is less than 1.5, the toners T are easily melted in the non-volatile oils. For this reason, even though the toners T are heated to be equal to or greater than the melting temperature by the first heating unit 80A and the second heating unit 80B, it is difficult to form two layers in which the layer obtained by melting the toners T and the oil layer are sequentially separated on the medium P.

In the image forming apparatus according to the second comparative embodiment, when the difference between the SP values of the toners T and the non-volatile oils is greater than 7.0, the toners T are excessively separated from the non-volatile oil. In other words, dispersibility of the toners T in the non-volatile oils is degraded. For this reason, in a developing process, the dispersibility of the toners T in the non-volatile oils is out of an allowable range, and thus, non-uniformity in density of the toner image developed on the photoconductor drum 12 occurs.

In contrast, in the image forming apparatus 200 according to the present exemplary embodiment, the difference between the SP values of the toners T and the non-volatile oils O ranges from 1.5 to 7.0. For this reason, when the toners T are heated to be equal to or greater than the melting temperature by the first heating unit 80A and the second heating unit 80B, two layers in which the layer obtained by melting the toners T and the oil layer are sequentially separated are easily formed on the medium P.

In the image forming apparatus 200 according to the present exemplary embodiment, the difference between the SP values of the toners T and the non-volatile oils ranges from 1.5 to 7.0. For this reason, in the developing process by the developing unit 18, the dispersibility of the toners T in the non-volatile oils is within an allowable range, and thus, the toner image having a density of the toners T within the allowable range is formed on the photoconductor drum 12.

Thereafter, in accordance with the image forming apparatus 200 according to the present exemplary embodiment, it is easy to form the oil layer outside the layer obtained by melting the toners T and it is possible to form an image having an image density within the allowable range as compared to the image forming apparatus according to the second comparative embodiment. Accordingly, in the first oil removing unit 50A and the second oil removing unit 500, oil removing efficiency is increased (oils are efficiently removed).

In the image forming apparatus according to the second comparative embodiment, when the difference between the SP values of the toners T and the non-volatile oils is less than 1.5, the toners T are easily melted in the non-volatile oils. In other words, the non-volatile oils remain in the image (layer to which, the toners T are firmly fixed) fixed on the medium P. As a result, the image fixed on the medium P is easily peeled off.

In contrast, in the image forming apparatus 200 according to the present exemplary embodiment, the difference between the SP values of the toners T and the non-volatile oils O ranges from 1.5 to 7.0. For this reason, in the fixing process by the fixing unit 70, since the non-volatile oils O are easily separated in a gap between the toners T, the oils O do not easily remain in the image fixed on the medium P. Accordingly, in the image on the medium P formed in the image forming apparatus 200 according to the present exemplary embodiment, bonding force between the toners T is higher than that when the difference between the SP values of the toners T and the oils is less than 1.5.

Thereafter, in accordance with the image forming apparatus 200 according to the present exemplary embodiment, the image fixed on the medium P is not easily peeled off as compared to the image forming apparatus according to the second comparative embodiment.

Other Effects

When the image forming apparatus 200 according to the present exemplary embodiment is used, in the second oil removing unit 500, the first image and the non-volatile oil O are heated by the oil removing roll 62B (elastic member 102) that presses against the first image and the non-volatile oil while being depressed. For this reason, the heat amount applied to the toners T constituting the second image is greater than that when the oil removing roll 62B is not depressed. Thus, it is easy to form the layer obtained by melting the toners T by melting the toners T on the back surface of the medium P, and thus, a portion of the non-volatile oils O is easily moved to the outside of the layer obtained by melting the toners T. That is, the oil removing roll 62B of the present exemplary embodiment may remove a large amount of non-volatile oils O from the back surface of the medium P as compared to the oil removing roll that is not depressed.

Therefore, in the image forming apparatus 200 according to the present exemplary embodiment, removal performance of the non-volatile oil O from the back surface of the medium P is improved.

Since a large amount of non-volatile oils O is removed from the back surface of the medium P, the heat amount corresponding to the removed amount (amount of the removed non-volatile oils O) is applied to the toners T constituting the toner image on the back surface of the medium P from the fixing unit 70. Thus, in the image forming apparatus 200 according to the present exemplary embodiment, the gloss of the image on the back surface of the medium P is improved as compared to the image forming apparatus 200 including the oil removing roll which is not depressed. Thereafter, in accordance with the image forming apparatus 200 according to the present exemplary embodiment, a difference in the gloss between the first fixing image and the second fixing image is reduced as compared to the image forming apparatus including the oil removing roll which is not depressed.

Second Exemplary Embodiment

Entire Configuration of Image Forming Apparatus

Hereinafter, an image forming apparatus 10 according to the present exemplary embodiment will be described with reference to FIG. 1.

In the following description, it is assumed that a direction represented by arrow 2 in FIG. 1 indicates a height direction of the apparatus and a direction represented by arrow X in FIG. 1 indicates a width direction of the apparatus. Further, it is assumed that a direction (represented by Y) perpendicular to the apparatus height direction and the apparatus width direction is a depth direction of the apparatus. When the image forming apparatus 10 is viewed from a front side, the apparatus height direction, the apparatus width direction and the apparatus depth direction are respectively described as a Z direction, an X direction and a Y direction.

When it is necessary to distinguish one side of the X direction, the Y direction or the Z direction from the other side thereof, in a front view of the image forming apparatus 10, an upper side is described as a +Z side, a lower side is described as a −Z side, a right side is described as a +X side, a left side is described as a −X side, a back side is described as a +Y side, and a front side is described as a −Y side.

The image forming apparatus 10 according to the present exemplary embodiment includes the transport device 90, the first image forming device 30, an inversion device 35, and a second image forming device 40. Operations of the respective components of the image forming apparatus 10 are controlled by a control device (not shown).

The image forming apparatus 10 according to the present exemplary embodiment has a difference from the image forming apparatus 200 according to the first exemplary embodiment in that the second image forming device 40 includes the second oil removing unit 50B. The image forming apparatus 10 according to the present exemplary embodiment has the same configuration as that of the image forming apparatus 200 according to the first exemplary embodiment except for the aforementioned difference. Differences between the image forming apparatus 10 according to the present exemplary embodiment and the image forming apparatus 200 according to the first exemplary embodiment will be described.

Figure 1:
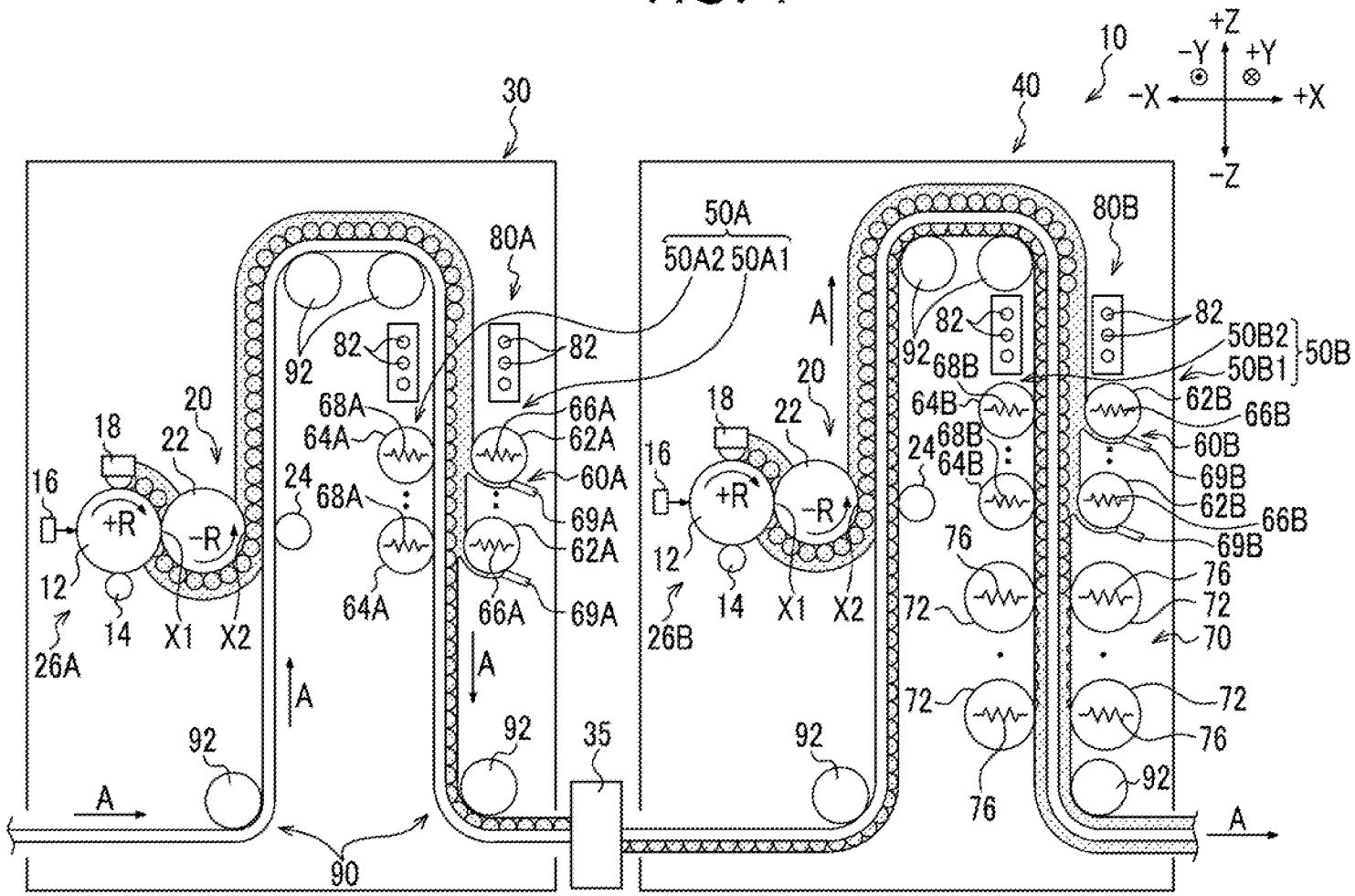
FIG. 1 is a schematic diagram (front view) of an image forming apparatus according to a second exemplary embodiment.

As shown in FIGS. 1 and 3B, the second oil removing unit 50B includes the oil removing unit 50B1 and a gloss reducing unit 50B2. Here, the second oil removing unit 50B is an example of another removing unit. The gloss reducing unit 50B2 is an example of a reducing section.

The gloss reducing unit 50B2 includes a press roll 64B, and the halogen heater 68B. The press roll 64B is formed in a cylindrical shape.

The press roll 64B is disposed to face the oil removing roll 62B with the transported medium P interposed therebetween, and has a function of pressing against the oil removing roll 62B. The press roll 64B includes the cylindrical member 100, and an elastic member 104. The elastic member 104 is fixed by adhering to the entire outer circumferential surface of the cylindrical member 100. A surface roughness of an outer circumferential surface of the elastic member 104 is coarser than the surface roughness of the outer circumferential surface of the elastic member 102. In other words, the surface roughness of the outer circumferential surface of the press roll 64B is coarser than the surface roughness of the cuter circumferential surface of the oil removing roll 62B. The surface roughness mentioned herein refers to an arithmetic average surface roughness. The press roll 64B has a function of fixing the toner image on the front surface of the medium P on the medium P by coming in contact with the non-volatile oils O heated on the front surface of the transported medium P and then reducing an increase in gloss (glossiness) of the image on the front surface of the medium P.

The halogen heater 68B is disposed inside the cylindrical member 100. The outer circumferential surface of the press roll 64B (elastic member 104) is heated to, for example 120° C. by the halogen heater 69B. Here, the elastic member 104 is an example of a second contact member.

Effects of Second Exemplary Embodiment

Next, the effects of the present exemplary embodiment will be described with reference to the drawings. The effects of the present exemplary embodiment will be described by being compared with a third comparative embodiment to be assumed below. In the following description, when the components used in the present exemplary embodiment are used, the effects thereof will be described using the reference numerals of these components. The "toner image formed on the front surface of the medium P by the first forming unit 26A" is referred to as the "first image", and the "toner image formed on the back surface of the medium P by the second image forming unit 26B" is referred to as the "second image".

In the image forming apparatus according to the third comparative embodiment, the press roll of the second oil removing unit has the same configuration as chat of the oil removing roll 62B. In other words, in the image forming apparatus according to the third comparative embodiment, a surface roughness of the outer circumferential surface of the press roll in the second oil removing unit is the same as the surface roughness of the outer circumferential surface of the oil removing roll 62B. That is, the surface roughness in the image forming apparatus according to the third comparative embodiment is set as in the image forming apparatus 200 according to the first exemplary embodiment. The image forming apparatus according to the third comparative embodiment has the same configuration as that of the present exemplary embodiment except for the aforementioned difference. It should be apparent that the image forming apparatus according to the third comparative embodiment (image forming apparatus 200 according to the first exemplary embodiment) is included in the technical scope of the present invention.

In the image forming apparatus according to the third comparative embodiment, the first image passes through the first heating unit 80A, the first oil removing unit 50A, the second heating unit 80B, the second oil removing unit 50B, and the fixing unit 70, and exits from the second image forming device 40. For this reason, before the toners T constituting the first image exit from the second image forming device 40, the toners are heated to be equal to or greater than the melting temperature of the toners T at five positions.

The second image passes through the second heating unit 80B, the second oil removing unit 50B and the fixing unit 70, and exits from the second image forming device 40. For this reason, before the toners T constituting the second image exit from the second image forming device 40, the toners are heated to be equal to or greater than the melting temperature of the toners T at three positions.

Thus, since a degree of melting the toners T constituting the first image is higher than that of the toners T constituting the second image, the image fixed on the front surface of the medium P has a gloss higher than that of the image fixed on the back surface of the medium P. As a result, a gloss difference occurs between the first fixing image and the second fixing image (see FIG. 7).

In contrast, as shown in FIGS. 3A and 3B, in the image forming apparatus 10 according to the present exemplary embodiment, the surface roughness of the outer circumferential surface of the press roll 64B is coarser than the surface roughness of the outer circumferential surface of the oil removing roll 62B. Thus, the first image before reaching the fixing unit 70 after passing through the second oil removing unit 50B of the present exemplary embodiment is coarser than the first image before reaching the fixing unit 70 after passing through the second oil removing unit 50B of the third comparative embodiment.

Figure 8:
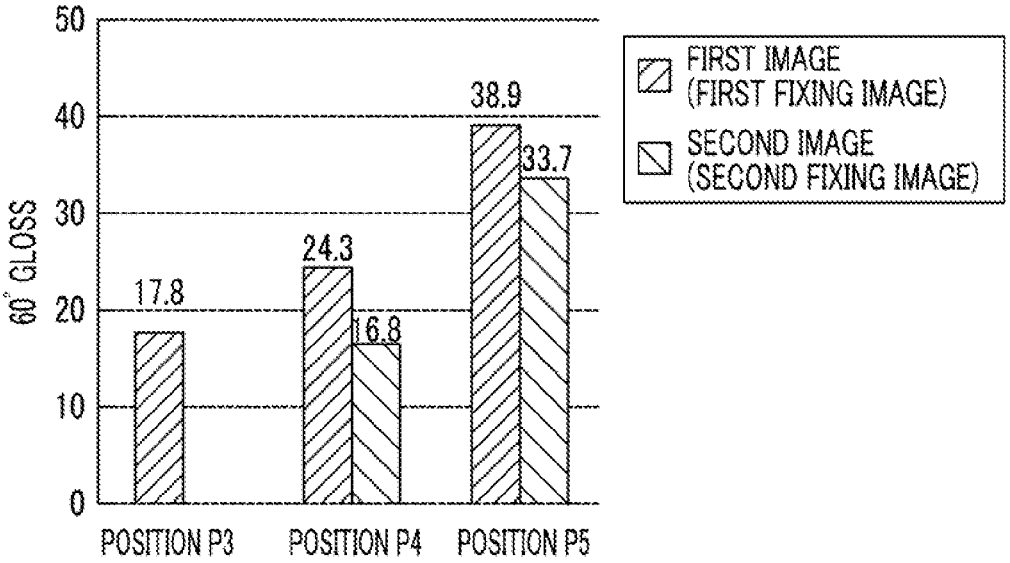
FIG. 8 is a graph showing the test result of Example 1.

Therefore, in accordance with the image forming apparatus 10 according to the present exemplary embodiment, the gloss difference between the first fixing image and the second fixing image is reduced as compared to the image forming apparatus according to the third comparative embodiment (see FIG. 8).

Other effects of the present exemplary embodiment are the same as those of the first exemplary embodiment.

Third Exemplary Embodiment

Figure 4A:
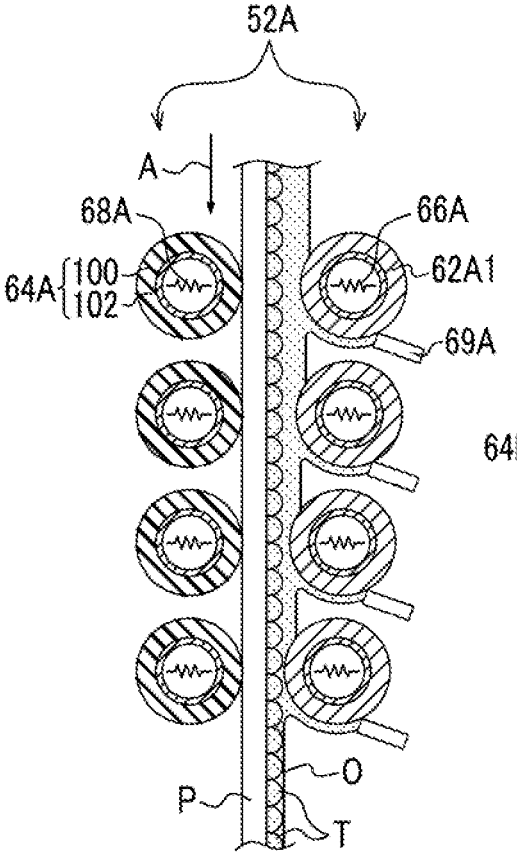
Figure 4B:
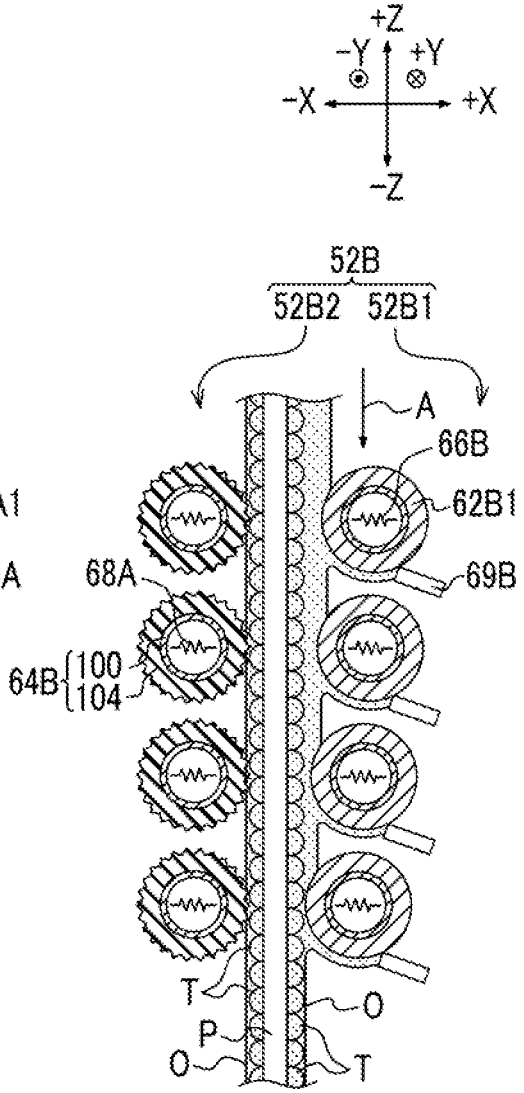

Next, a third exemplary embodiment will be described with reference to FIGS. 4A and 4B. In the following description, when the components used in the first and second exemplary embodiments are used, the third exemplary embodiment will be described using the reference numerals of these components.

Configuration of Third Exemplary Embodiment

The image forming apparatus 10 according to the third exemplary embodiment includes a first oil removing unit 52A and a second oil removing unit 52B instead of the first oil removing unit 50A and the second oil removing unit 50B of the image forming apparatus 10 according to the second exemplary embodiment. The image forming apparatus 10 according to the third exemplary embodiment is different from the image forming apparatus 10 according to the second exemplary embodiment in this regard. Here, the first oil removing unit 52A is an example of a removing unit. The second oil removing unit 52B is an example of another removing unit.

First Oil Removing Unit

The first oil removing unit 52A includes an oil removing roll 62A1, the press roll 64A, and the halogen heater 68A.

Oil Removing Roll

The oil removing roll 62A1 is a cylindrical member 62A1 made from, a metal. A halogen heater 66A is disposed inside the metal cylindrical member 62A1. An outer circumferential surface of the oil removing roll 62A1 is heated to, for example, 120° C. by the halogen heater 66A. An external appearance of the oil removing roll 62A1 is the same as that of the oil removing roll 62A.

Press Roll

The press roll 64A has the same configuration as that of the press roll 64A of the second exemplary embodiment. An outer circumferential surface of the press roll 64A (elastic member 102) is heated to, for example, 120° C. by the halogen heater 68A.

Second Oil Removing Unit

The second oil removing unit 52B includes an oil removing unit 52B1, and a gloss reducing unit 52B2. Here, the second oil removing unit 52B is an example of another removing unit. The oil removing unit 52B1 is an example of a removing section. The gloss reducing unit 52B2 is an example of a reducing section.

Oil Removing Unit

The oil removing unit 52B1 includes an oil removing roll 62B1, the halogen heater 66B, and the recovery blade 69B. The oil removing roll 62B1 is a cylindrical member 62B1 made from a metal. In other words, a portion, of the oil removing roll 62B1 which comes in contact with the toner image formed on the front surface of the medium P by the second image forming unit 26B is formed as a metal layer. The halogen heater 66B is disposed inside the cylindrical member 62B1. An outer circumferential surface of the oil removing roll 62B1 is heated to, for example, 120° C. by the halogen heater 66B. The metal cylindrical member 62B1 has the same configuration as that of the metal cylindrical member 62A1. An external appearance of the oil removing roll 62B1 is the same as that of the oil removing roll 62B. The metal cylindrical member 62B1 is an example of a first contact member.

Gloss Reducing Unit

The gloss reducing unit 52B2 has the same configuration as that of the gloss reducing unit 50B2 of the second exemplary embodiment. An outer circumferential surface of the press roll 64B (elastic member 104) is heated to, 120° C. by the halogen heater 68B.

Effects of Third Exemplary Embodiment

In the image forming apparatus 10 according to the present exemplary embodiment, the oil removing rolls 62A1 and 62B1 are made from a metal. That is, the oil removing rolls 62A1 and 62B1 have a thermal conductivity higher than that of the oil removing rolls 62A and 62B of the second exemplary embodiment. Thus, the toners T of the present exemplary embodiment are melted on the front surface and the back surface of the medium P, and thus, it is easy to form, the layer obtained by melting the toners T as compared to the toners T of the second exemplary embodiment. As compared to the toners T of the second exemplary embodiment, when the toners T of the present exemplary embodiment are used, a part of the non-volatile oils O is easily moved to the outside of the layer obtained by melting the toners T. Therefore, in the image forming apparatus 10 according to the present exemplary embodiment, removal performance of the non-volatile oils O from the front surface and the back surface of the medium P is improved.

When the image forming apparatus 10 according to the present exemplary embodiment is used, in the second oil removing unit 52B, the first image and the non-volatile oil O are heated by the oil removing roll 62B1 (metal cylindrical member 62B1). For this reason, the heat amount applied to the non-volatile oil O on the back surface of the medium P is greater than that of an oil removing roll made from a rubber (an example of the oil removing roll having a thermal conductivity lower than that of the metal oil removing roll). That is, the oil removing roll 62B1 of the present exemplary embodiment may remove a greater amount of non-volatile oils O from the back surface of the medium P than that of the rubber oil removing roll. Therefore, in the image forming apparatus 10 according to the present exemplary embodiment, the removal performance of the non-volatile oils O from the back surface of the medium P is improved.

Since a large amount of non-volatile oils O is removed from the back surface of the medium P, the heat amount corresponding to the removed amount (amount of the removed non-volatile oils O) is applied to the toners T constituting the toner image on the back surface of the medium P from the fixing unit 70. Thus, in the image forming apparatus 10 according to the present exemplary embodiment, the gloss of the image on the back surface of the medium P is improved as compared to the image forming apparatus including the rubber oil removing roll. Accordingly, in accordance with the image forming apparatus 10 according to the present exemplary embodiment, the gloss difference between the first fixing image and the second fixing image is reduced as compared to the image forming apparatus including the rubber oil removing roll.

Other effects of the present exemplary embodiment are the same as those of the first and second exemplary embodiments.

Fourth Exemplary Embodiment

Next, a fourth exemplary embodiment will be described with reference to FIGS. 5A and 5B. In she following description, when the components used in the first to third exemplary embodiment are used, the fourth exemplary embodiment will be described using the reference numerals of these components.

Configuration of Fourth Exemplary Embodiment

The image forming apparatus 10 according to the fourth exemplary embodiment includes a first oil removing unit 54A and a second oil removing unit 54B instead of the first oil removing unit 50A and the second oil removing unit 50B of the image forming apparatus 10 according to the second exemplary embodiment. The image forming apparatus 10 according to the fourth exemplary embodiment is different from the image forming apparatus 10 according to the second exemplary embodiment in this regard. Here, the first oil removing unit 54A is an example of a removing unit. The second oil removing unit 543 is an example of another removing unit.

First Oil Removing Unit

The first oil removing unit 54A has the same configuration as that of the first oil removing unit 50A of the second exemplary embodiment. An outer circumferential surface of the oil removing roll 62A (elastic member 102) and an outer circumferential surface of the press roll 64A (elastic member 102) are respectively heated to, for example, 120° C. by a halogen heater 60A and the halogen heater 68A.

Second Oil Removing Unit

The second oil removing unit 54B includes an oil removing unit 54B1, and a gloss reducing unit 54B2. Here, the oil removing unit 54B1 is an example of a removing section. The gloss reducing unit 54B2 is an example of a reducing section.

Oil Removing Unit

The oil removing unit 54B1 has the same configuration as that of the oil removing unit 50B1 of the second exemplary embodiment. An outer circumferential surface of an oil removing roll. 62B (elastic member 102) is heated to, for example, 120° C. by the halogen heater 66B. Here, the elastic member 102 constituting the oil removing roll 62B is an example of a first contact member.

Gloss Reducing Unit

The press roll 64B has the same configuration as that of the press roll 64B of the second exemplary embodiment. An outer circumferential surface of the press roll 64B (elastic member 102) is heated to, 100° C. by the halogen heater 66B. In other words, the outer circumferential surface of the press roll 64B (elastic member 102) comes in contact with the first image at a temperature less than that of the outer circumferential surface of the oil removing roll 62B (elastic member 102). The temperature less than that of the outer circumferential surface of the oil removing roll 62B (elastic member 102) is a temperature less than the melting temperature of the toners T. Here, the elastic member 102 constituting the press roll 64B is an example of a second contact member.

Effects of Fourth Exemplary Embodiment

In the third comparative embodiment, since the heat amount applied before the first image is fixed on the medium P is greater than the heat amount applied before the second image is fixed on the medium P, the gloss of the first fixing image is higher than the gloss of the second fixing image. As described above, the gloss difference also occurs between the first fixing image and the second fixing image.

The heat amount applied before the second image of the present exemplary embodiment is fixed on the medium P (before the second image exits from the second image forming device 40) is the same as the heat amount applied before the second image of the third comparative embodiment is fixed on the medium P. The gloss of the second fixing image of the present exemplary embodiment is the same as the gloss of the second fixing image of the third comparative embodiment.

In contrast, in the image forming apparatus 10 according to the present exemplary embodiment, the outer circumferential surface of the press roll 64B of the second oil removing unit 54B is heated to, for example, 100° C. A temperature of the outer circumferential surface of the press roll 64B of the second oil removing unit 54B is less than the temperature (for example, 120° C.) of the outer circumferential surface of the press roll constituting the second, oil removing unit of the third comparative embodiment. That is, the heat amount applied before the first image of the present exemplary embodiment is fixed on the medium P is smaller than the heat amount applied before the first image of the third comparative embodiment is fixed on the medium P. For this reason, the gloss of the first fixing image of the present exemplary embodiment is lower than the gloss of the first fixing image of the third comparative embodiment.

Figure 12:
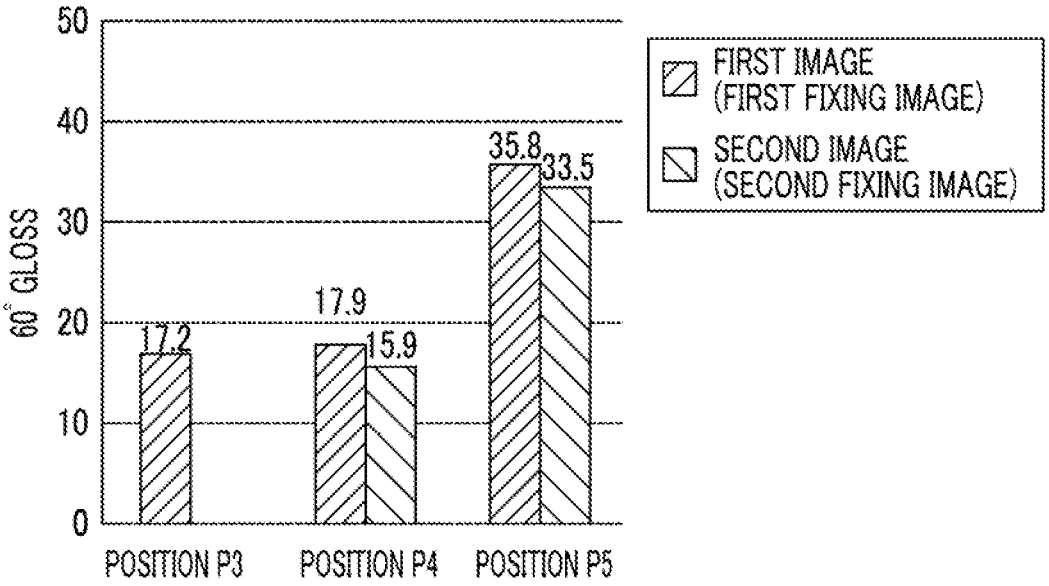
FIG. 12 is a graph showing the test result of Test 2-4 of Example 2, and a graph showing the 60° gloss of the toner images (the first image (first fixing image) and the second image (second fixing image)) formed on the front surface and the back surface of the medium in the respective positions.

Therefore, in accordance with, the image forming apparatus 10 according to the present exemplary embodiment, the gloss difference between the first fixing image and the second fixing image is reduced as compared to the image forming apparatus according to the third comparative embodiment (see FIG. 12). Other effects of the present exemplary embodiment are the same as those of the first to third exemplary embodiments.

Fifth Exemplary Embodiment

Next, a fifth exemplary embodiment will be described with reference to FIGS. 17A and 17B. In the following description, when the components used in the first to fourth exemplary embodiments are used, the fifth exemplary embodiment will be described using the reference numerals of these components.

Configuration of Fifth Exemplary Embodiment

The image forming apparatus 10 according to the fifth exemplary embodiment includes a first oil removing unit 58A and a second oil removing unit 58B instead of the first oil removing unit 50A and the second oil removing unit 50B of the image forming apparatus 10 according to the second exemplary embodiment. The image forming apparatus 10 according to the fifth exemplary embodiment is different from the image forming apparatus 10 according to the second exemplary embodiment in this regard. Here, the first oil removing unit 58A is an example of a removing unit.

First Oil Removing Unit

The first oil removing unit 58A includes an oil removing roll 64B, the press roll 64A, a halogen heater 66A, the halogen heater 68A, and the recovery blade 69A. Here, the oil removing roll 64B is an example of a second contact member and a reducing section.

The oil removing roll 64B of the present exemplary embodiment has the same configuration as that of the oil removing roll 64B constituting the second oil removing unit 50B of the second exemplary embodiment. The oil removing roll 64B of the present exemplary embodiment has a function of rotating while coming in contact with the non-volatile oil O on the front surface of the transported medium P. The oil removing roll 64B comes in contact with the non-volatile oil O heated on the front surface of the transported medium P, and then the toner image on the front surface of the medium P is fixed on the medium P, thereby reducing an increase in gloss (glossiness) of the image on the front surface of the medium P. The recovery blade 69A has a function of recovering the non-volatile oil O moved to the outer circumferential surface of the oil removing roll 62A by coming in contact with the outer circumferential surface of the oil removing roll 62A. The press roll 64A has the same configuration as that of the press roll 64A of the second exemplary embodiment.

Second Oil Removing Unit

The second oil removing unit 58B includes an oil removing unit 58B1, and a press unit 58B2. Here, the oil removing unit 58B1 is an example of a removing section. The oil removing unit 58B1 has the same configuration as that of the oil removing unit 58B1 of the first exemplary embodiment. The press unit 58B2 has the same configuration as that of the press unit. 500A of the first exemplary embodiment. Here, the oil removing roll 62B of the oil removing unit. 58B1 is an example of a first contact member.

A surface roughness of an outer circumferential surface of the oil removing roll 64B of the first oil removing unit 58A is coarser than the surface roughness of the outer circumferential surface of the oil removing roll 62B of the second oil removing unit 58B.

Effects of Fifth Exemplary Embodiment

The effects of the present exemplary embodiment are the same as those of the first to fourth exemplary embodiments.

Reference Example

Figure 6A:
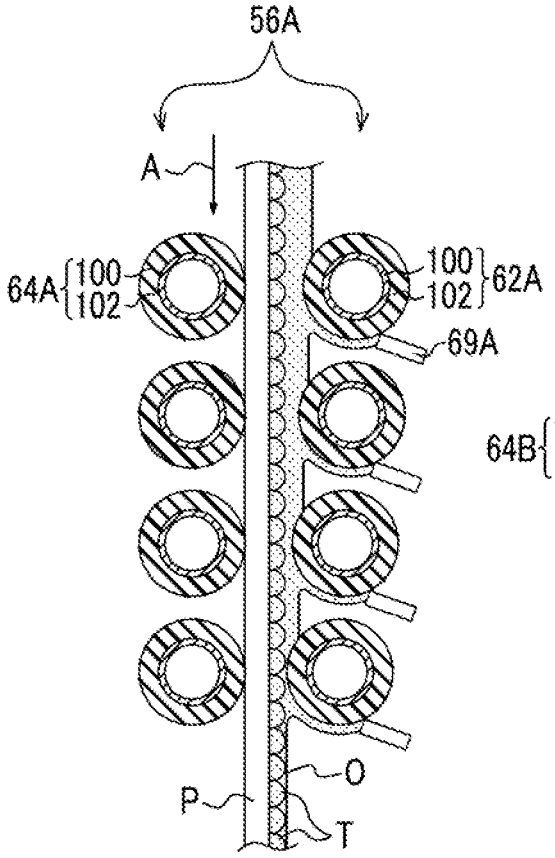
Figure 6B:
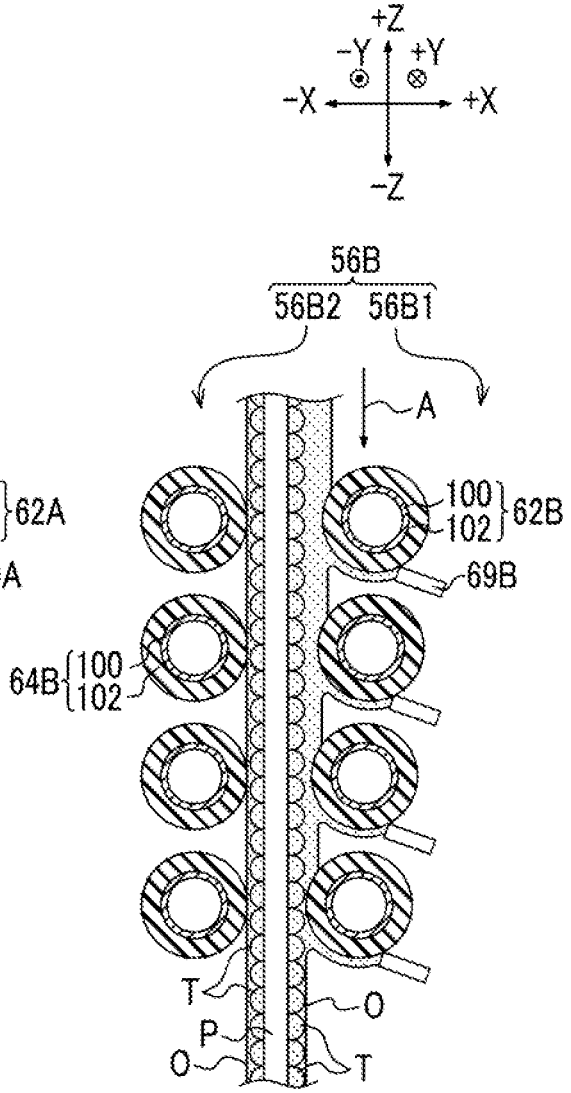

Next, the reference example will be described with reference to FIGS. 6A and 6B. In the following description, when the components used in the first to fifth exemplary embodiments are used, the reference example will be described using the reference numerals of these components.

Configuration of Reference Example

The image forming apparatus 10 according to a reference example includes a first oil removing unit 56A and a second oil removing unit 56B instead of the first oil removing unit 54A and the second oil removing unit 54B of the image forming apparatus 10 according to the fourth exemplary embodiment. The image forming apparatus 10 according to the reference example does not include the first heating unit 80A and the second heating unit 80B. The image forming apparatus 10 according to the reference example is different from the image forming apparatus 10 according to the fourth exemplary embodiment in this regard.

First Oil Removing Unit 56A

The first oil removing unit 56A has the same configuration as that of the first oil removing unit 54A except that the first oil removing unit 56A does not include the halogen heaters 66A and 68A. Thus, an outer circumferential surface of the oil removing roll 52A (elastic member 102) and an outer circumferential surface of the press roll 64A (elastic member 102) are not heated.

Second Oil Removing Unit 56B

The second oil removing unit 56B has the same configuration as that of the second oil removing unit 54B except that the second oil removing unit 56B does not include the halogen heaters 66B and 68B. In other words, an oil removing unit 56B1 and a gloss reducing unit 56B2 constituting the second oil removing unit 58B include the cylindrical member 100 and the elastic member 102. Thus, an outer circumferential surface of the oil removing roll 62B (elastic member 102) and an outer circumferential surface of the press roll 64B (elastic member 102) are not heated. In other words, the outer circumferential surface of the press roll 64B (elastic member 102) comes in contact with the first image at a temperature of the outer circumferential surface of the oil removing roll 62B (elastic member 102) and a temperature less than the melting temperature of the toners T.

Effects of Reference Example

In the image forming apparatus 10 according to the reference example, the first image and the second image are heated in only the fixing unit 70. That is, the heat amount applied before the first image is fixed on the medium P and the heat amount applied before the second image is fixed on the medium P are the same. Thus, the gloss of the first fixing image of the present exemplary embodiment is the same as the gloss of the first fixing image of the third comparative embodiment.

Therefore, in accordance with the image forming apparatus 10 according to the reference example, the gloss difference between the first fixing image and the second fixing image is reduced as compared to the image forming apparatus according to the third comparative embodiment.

Other effects of the present reference example are the same as those of the first to fifth exemplary embodiments.

As mentioned above, although the present invention has been described in conjunction with the specific exemplary embodiments, the present invention is not limited to the aforementioned exemplary embodiments, and other embodiments may be possible within the scope of the present invention.

For example, it has been described in the exemplary embodiments that the non-volatile oils O are silicone oils, but any oil other than a silicone oil may be used when the oils as long as the oil satisfies the non-volatility condition (a volatile component is equal to or less than 8% by weight after 24 hours at a flash point of 13° C. or more or 150° C.). For example, a paraffin-based oil, an ether-based oil, a plant-based oil, or any oil that satisfies the aforementioned condition may be used. An oil obtained by mixing these oils with each other may be used.

In the exemplary embodiments, it has been described that the difference between the SP values of the toners T and the non-volatile oils O ranges from 1.5 to 7.0. However, even when the difference between the SP values of the toners T and the non-volatile oils O is less than 1.5 or greater than 7.0, the gloss difference between the first image and the second image is reduced by the image forming apparatuses 10 according to the exemplary embodiments. Accordingly, even when the difference between the SP values of the toners T and the non-volatile oils O is less than 1.5 or greater than 7.0, the image forming apparatuses according to the exemplary embodiments are included in the technical scope of the present invention.

The image forming apparatuses 200 and 10 according to the exemplary embodiments include the first heating unit 80A and the second heating unit 80B. The first heating unit 80A and the second heating unit 80B form the oil layer on the outer surface of the medium P. Accordingly, the image forming apparatuses 200 and 10 may not include the first heating unit 80A and the second heating unit 80B as long as the oil layer may be formed and the oils O may be removed in the first oil removing unit 50A and the second oil removing unit 50B.

The image forming apparatuses 200 and 10 according to the exemplary embodiments include the first image forming unit 26A and the second image forming unit 26B. That is, in the image forming apparatus 10 according to the present exemplary embodiment, only single-color toner images are respectively formed on the front surface and the back surface of the medium P. However, such a configuration is an example of the image forming apparatus 10, and may include plural first image forming units 26A such that a multi-color toner image is formed on the front surface of the medium P and may include plural second image forming units 26B such that a multi-color toner image is formed on the back surface of the medium P.

It has been described in the image forming apparatuses 200 and 10 according to the exemplary embodiments that the continuous sheet is transported by the transport device 90 and the image is formed. However, the continuous sheet is an example of the medium P, and in the image forming apparatuses 200 and 10, as another embodiment of the transport device 90, a cut sheet may be transported by the transport device of the another embodiment, and an image may be formed.

The image forming apparatuses 200 and 10 according to the exemplary embodiments include the first image forming device 30, the inversion device 35, and the second image forming devices 400 and 40. However, the case where the image forming apparatuses 200 and 10 include these devices as separate devices is an example, and the image forming apparatuses 200 and 10 may integrally include the first image forming device 30, the inversion device 35, and the second image forming devices 400 and 40. The image forming apparatuses 200 and 10 may integrally include the first image forming device 30, the inversion device 35, the second image forming devices 400 and 40, and the transport device 90. The image forming apparatuses 200 and 10 may include the fixing unit 70 constituting the second image forming devices 400 and 40 as a separate device.

The image forming apparatuses 200 and 10 according to the exemplary embodiments include the inversion device 35. However, even though the medium P sent from the first image forming device 30 is not inverted, the image forming apparatuses 200 and 10 may not include the inversion device 35 as long as the toner image may be formed on the back surface of the medium P by the second image forming devices 400 and 40.

In the aforementioned description, the respective exemplary embodiments have been individually described. However, for example, the configurations of the respective exemplary embodiments may be combined as long as the gloss reducing section such as the gloss reducing unit 50B2 of the second exemplary embodiment is provided. For example, the image forming apparatus according to the present invention may be an image forming apparatus configured by combining the first oil removing unit 50A of the second exemplary embodiment with the second oil removing unit 52B of the third exemplary embodiment. The image forming apparatus according to the present invention may be an image forming apparatus configured by combining the press roll 64B of the first or second exemplary embodiment with the heating condition (the outer circumferential surface of the press roll 64B is heated to 100° C.) by the halogen heater 68B of the fourth exemplary embodiment. The image forming apparatus according to the present invention may be an image forming apparatus configured by combining the first oil removing unit 58A of the fifth exemplary embodiment with the second oil removing unit 50B of the second exemplary embodiment. The oil removing roll 62B constituting the second oil removing unit 58B of the fifth exemplary embodiment may be configured as the oil removing roll 66B constituting the second oil removing unit 52B of the third exemplary embodiment.

It has been described in the image forming apparatuses 10 according to the second to fourth exemplary embodiments that the oil removing unit 50B1 and the gloss reducing unit 50B2 constitute the second oil removing unit 50B. Further, it has been described that the oil removing unit 50B1 and the gloss reducing unit 50B2 are arranged to face each ether with the medium P interposed therebetween. However, the oil removing unit 50B1 and the gloss reducing unit 50B2 may not be arranged to face each other with the medium P interposed therebetween as long as the oil removing unit 50B1 has a function of removing the non-volatile oils O from, the back surface of the medium P and the gloss reducing unit 50B2 has a function, of reducing an increase in gloss of the image on the front surface of the medium P.

It has been described in the image forming apparatus 10 according to the second exemplary embodiment that the first oil removing unit 50A is an example of the removing unit. The removing unit is disposed on the downstream side of the first image forming unit 26A in the transport direction of the medium P, and has a function of heating the non-volatile oils O on the front surface of the medium P to remove the oils. In this regard, a combination of the first oil removing unit 50A and the first heating unit 80A may be used as an example of the removing unit. When the combination of the first oil removing unit 50A and the first heating unit. 80A is used as an example of the removing unit, the first heating unit 80A may have a function of the removing unit that heats the non-volatile oils O on the front surface of the medium P. In the third or fourth exemplary embodiment, instead of the first oil removing unit 50A of the second exemplary embodiment, a combination of the first oil removing unit 52A of the third exemplary embodiment or the first oil removing unit 54A of the fourth exemplary embodiment with the first heating unit may foe used as an example of the removing unit.

It has been described in the image forming apparatus 10 according to the second exemplary embodiment that the second oil removing unit 50B is an example of another removing unit. It has been described that another removing unit includes the oil removing unit 50B1 and the gloss reducing unit 50B2. It has been described that another removing unit has a function of heating the oils O on the back surface of the medium P to remove the oils and a function of causing the toner image to be coarse using the toners T constituting the toner image on the front surface of the medium P. More specifically, the oil removing unit 50B1 has a function of heating the oils O on the back surface of the medium P to remove the oils, and the gloss reducing unit 50B2 has a function of causing the toner image on the front surface of the medium P to be coarse. In this regard, a combination of the oil removing unit 50B1 and the second heating unit 80B may be used as an example of the another removing unit. When the combination of the oil removing unit 50B1 and the second heating unit 80B may be used as an example of the another removing unit, the second heating unit 80B may have a function of the another removing unit that heats the oils O on the back surface of the medium P to remove the oils. When a combination of the oil removing unit 50B1, the second heating unit 80B and the halogen heater 68B is used as an example of the another removing unit, the second heating unit 80B and the halogen heaters 66B and 68B may have a function of the another removing unit that heats the oils O on the back surface of the medium P to remove the oils. With the aforementioned configuration, the press roll 64B is an example of the gloss reducing unit. In the third exemplary embodiment, instead of the second oil removing unit 50B of the second exemplary embodiment, the second, oil removing unit 52B of the third exemplary embodiment may be used, and thus, the aforementioned combinations may foe used as an example of the another removing unit.

It has been, described that the oil removing rolls constituting the first oil removing unit 50A, 52A, 54A, 56A and 58A of the image forming apparatuses 200 and 10 according to the exemplary embodiments are heated to, for example, 120° C. It has been described that the oil removing rolls constituting the second oil removing unit 50B, 52B, 54B, 56B and 58B of the image forming apparatuses 200 and 10 according to the exemplary embodiments are heated to, for example, 120° C. However, the case where the oil removing roll is heated to 120° C. is an example of the respective exemplary embodiments, and in the image forming apparatus according to the present invention, the oil removing roll may not be heated to 120° C. Any roll has a function of the oil removing roll as long as an outer circumferential surface of the oil removing roll is heated to, for example, 90° C. or more.

EXAMPLES

Next, examples will be described with reference to the drawings. In the examples, test 1 and test 2 are conducted.

Test 1

Outline

Test 1 is a test which focuses on the roughness (surface roughness) of the outer circumferential surface of the press roll 64B constituting the second oil removing unit 50B. Specifically, the first image and the second image are formed on the medium P by the image forming apparatuses 10 according to the second exemplary embodiment and the comparative embodiment described above, and the 60° C. gloss is measured in the respective steps. In the following description, the test is conducted under the condition of the image forming apparatus 10 according to the aforementioned second exemplary embodiment unless the condition is particularly described otherwise.

Testing Method

In Example 1, the roughness of the outer circumferential surface of the oil removing roll 62B constituting the second oil removing unit 50B is 09 μm, and the roughness of the outer circumferential surface of the press roll 64B is 5.9 μm. The first image and the second image are formed on the medium P by the image forming apparatus 10 according to the second exemplary embodiment. The first image and the second image are formed by forming a solid image of 100% density on the entire image-formable region (however, the image is not formed in regions of 10 mm from both edges of the medium P) of OK topcoat+ (medium P) using the same developer (black toners).

The 60° gloss of the first image and the 60° gloss of the second image are respectively measured and compared at a position after passing through the second heating unit 80B and before reaching the second oil removing unit 50B, a position after passing through the second oil removing unit 50B and before reaching the fixing unit 70, and a position after passing through the fixing unit 70 (after fixing). The 60° gloss of the second image is not measured at a position after passing through the second heating unit 80B and before reaching the second oil removing unit 50B.

In Comparative Example 1, the roughness of the outer circumferential surface of the oil removing roll 62B constituting the second oil removing unit 50B is 0.9 μm, and the roughness of the outer circumferential surface of the press roll 64B is 0.9 μm. Similarly to Example 1, the 60° gloss of the first image and the 60° gloss of the second image at the aforementioned three positions are measured and compared.

Figure 7:
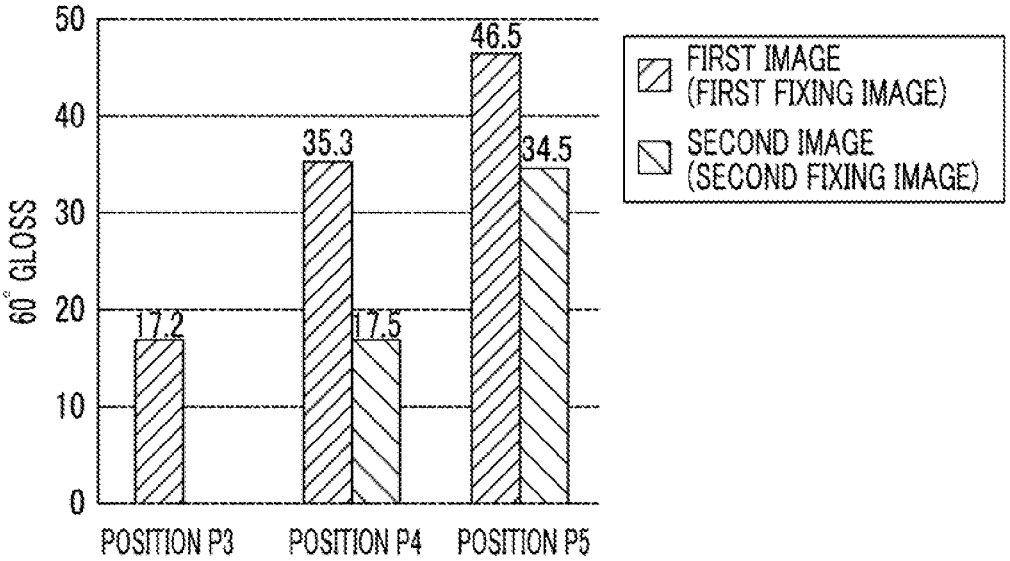
FIG. 7 is a graph showing the test result of a comparative example (Comparative Example 1) of Example 1.

The roughness of the outer circumferential surface of the oil removing roll 62B and the roughness of the outer circumferential surface of the press roll 64B refer to an arithmetic average surface roughness. A graph of FIG. 7 shows the test result of Comparative Example 1, and a graph of FIG. 8 shows a test result of Example 1. Here, Position P3 indicates a position on a downstream side of the second heating unit 80B and an upstream side of the second oil removing unit 50B in the transport path of the medium P.

Test Result and Examination

Hereinafter, test results of Comparative Example 1 and Example 1 will foe described, with reference to the graphs of FIGS. 7 and 8.

In Comparative Example 1, as shown in the graph of FIG. 7, the gloss difference between the first image and the second image in Position P4 is 17.8, and the gloss difference therebetween after fixing is 12.0.

In contrast, in Example 1, as shown in the graph of FIG. 8, the gloss difference between the first image and the second image in Position P4 is 7.5, and the gloss difference therebetween after fixing is 5.2.

From the above-described test results, it is seen that when the surface roughness of the press roll 64B of the second oil removing unit 50B is coarser than the surface roughness of the oil removing roll 62B, the gloss difference between the first image and the second image may be reduced. Example 1 shows the test result of the medium P on which the images are formed by the configuration of the image forming apparatus 10 according to the second exemplary embodiment. Comparative Example 1 shows the test result of the medium P on which the images are formed by the configuration of the image forming apparatus according to the aforementioned third exemplary embodiment. Therefore, from the test result of Example 1 and the test result of Comparative Example 1, it is verified that the gloss difference between the first image and the second image is reduced in the image forming apparatus 10 according to the second exemplary embodiment in comparison to the image forming apparatus according to the comparative embodiment.

Test 2

Example 2

Outline

Test 2 is a test which focuses on the heating temperature of the outer circumferential surface of the press roll 64B constituting the second oil removing unit 50B. Specifically, Tests 2-1, 2-2 and 2-3 to be described below are conducted, the first image and the second image are formed on the medium P by the image forming apparatus 10 according to the aforementioned fourth exemplary embodiment in Test 2-4, and the 60° gloss is measured in the respective steps. In the following description, the test is conducted under the condition of the image forming apparatus 10 according to the aforementioned fourth exemplary embodiment unless the condition is particularly described otherwise.

In Test 2, the tests in which a relationship between the temperature of the toners T and the viscosity of the toners T and a relationship between the temperature of the toners T and the 60° gloss of the toners T are investigated are conducted (hereinafter, respectively referred to as Test 2-1 and Test 2-2). A relationship between the 60° gloss and the viscosity of the developer is obtained from these two relationships, and a condition where the gloss difference between the first image and the second image is reduced may be derived from the viscosity of the developer (hereinafter, referred to as Test 2-3).

Hereinafter, these tests will foe described.

Test 2-1

Figure 9:
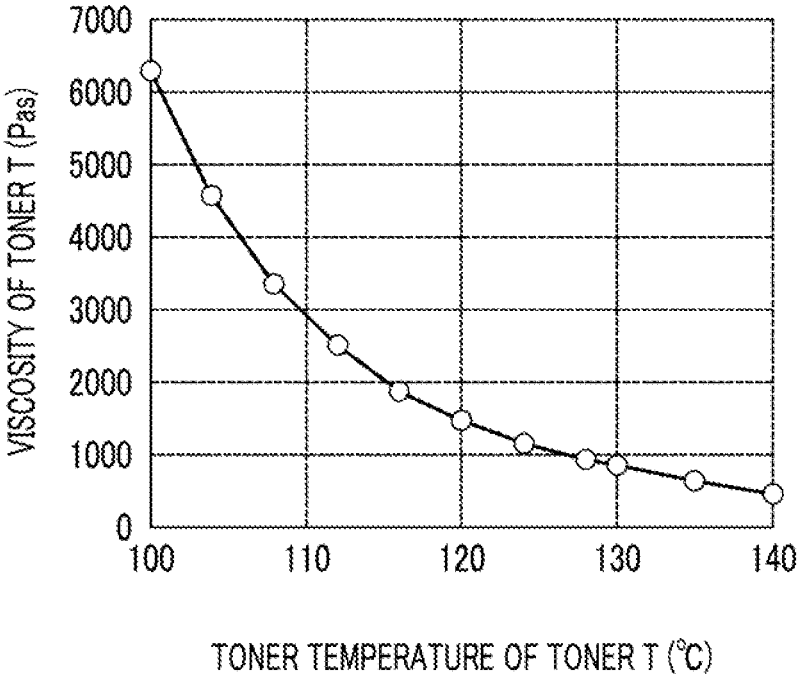
FIG. 9 is a graph showing the test result of Test 2-1 of Example 2, and a graph showing the relationship between the toner temperature of the toners and the viscosity of the toners.

The relationship between the temperature of the toners T and the viscosity of the developer is investigated using a viscosity measuring instrument (HAAKE MARKSIII manufactured by Thermo Fisher Scientific K.K.). The measured result is as shown in a graph of FIG. 9.

Test 2-2

Next, the test in which the relationship between the 60° gloss and the toner temperature of the toners T constituting the first image in Position P4 is investigated is conducted. In this test, the roughness of the outer circumferential surface of the oil removing roll 62B constituting the second oil removing unit 50B is 0.9 μm. The roughness of the outer circumferential surface of the press roll 64B constituting the second oil removing unit 50B is 0.9 μm. The roughnesses of the outer circumferential surfaces refer to an arithmetic average surface roughness. In this test, the second oil removing unit 50B satisfying these conditions is used, and the temperatures of the outer circumferential surfaces of the press roll 64B and the oil removing roll 62B are set to be from 100° C. to 140° C. The toner temperature of the toners T constituting the first image in Position P4 is measured using a radiation thermometer, and the relationship between the measured toner temperature of the toners T and the 60° C. gloss of the first image is obtained.

Figure 10:
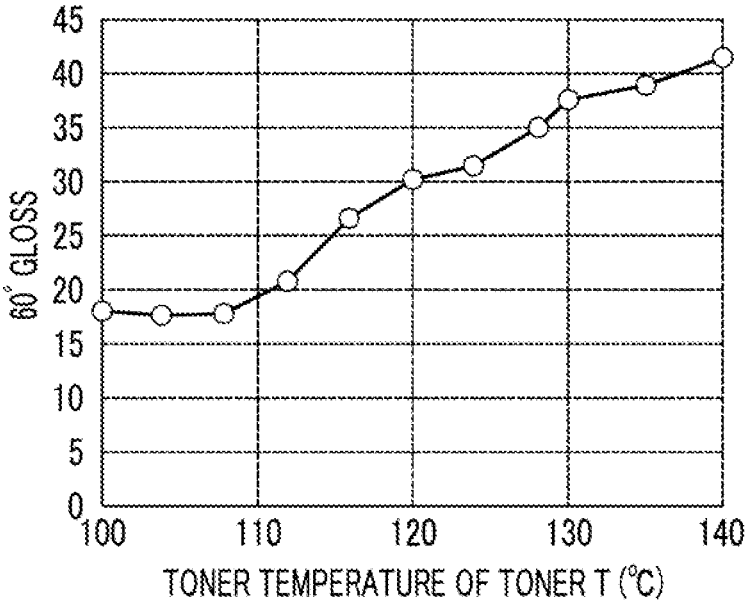
FIG. 10 is a graph showing the test result of Test 2-2 of Example 2, and a graph showing the relationship between the 60° gloss and the toner temperature of the toners on the medium.

The test result for the relationship between temperature of the toners T and the 60° C. gloss of the developer is as shown in a graph of FIG. 10. As shown in FIG. 10, when the toner temperature of the toners T is approximately 110° C. or less, the 60° gloss is approximately 17 regardless of the toner temperature of the toners T. The reason is because the gloss of the first image after passing through the first oil removing unit 50A is approximately 17. That is, the first image is heated to 120° C. in the first oil removing unit 50A, but the 60° gloss does not almost change even though the first image is heated at a temperature of equal to or less than 120° C. in the second oil removing unit 50B.

Test 2-3

Next, from the aforementioned test results for the relationship between the temperature of the toners T and the viscosity of the toners T and the relationship between the temperature of the toners T and the 60° gloss of the toners T, the relationship between the 60° gloss and the viscosity of the toners T is obtained. The obtained result is a graph shown in a graph of FIG. 11.

Figure 11:
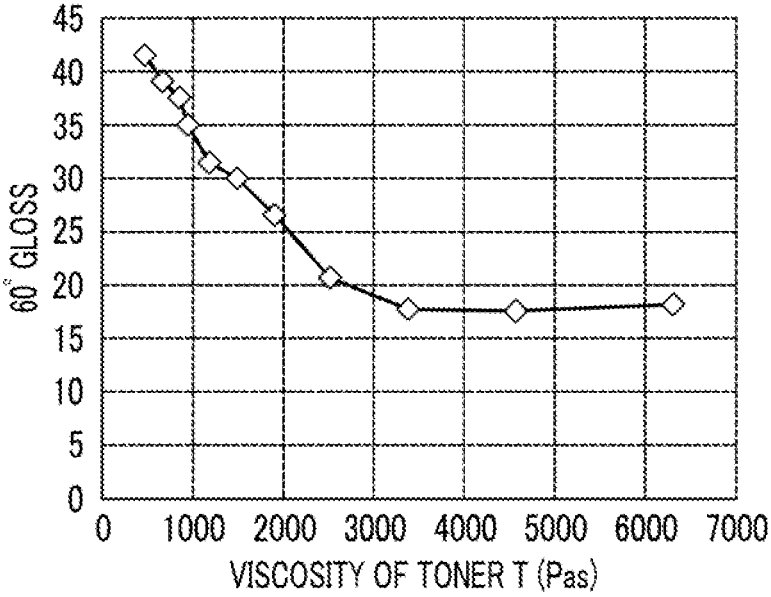
FIG. 11 is a graph showing the test result of Test 2-3 of Example 2, and a graph showing the relationship between the 60° gloss and the viscosity of the toners.

When the tests are conducted using the image forming apparatus 10 according to the fourth exemplary embodiment, the gloss of the first image after passing through the first oil removing unit 50A is approximately 17. As shown in the graph of FIG. 11, in order to allow the gloss of the first image passing through the second oil removing unit 50B to be approximately 17 (so as not to become greater), it is seen that the viscosity of the toners T needs to be approximately 3000 Pas or more.

From the result of Test 2-3 obtained based on the test results of Tests 2-1 and 2-2, when the temperature of the outer circumferential surface of the press roll 64B of the second oil removing unit 50B is set as follows, it is seen that, an increase in the gloss of the first image in Position P4 may be suppressed. That is, when the temperature of the outer circumferential surface of the press roll 64B is set to a temperature satisfying a condition where the viscosity of the toners T on the front surface of the medium P is greater than 3000 Pas, the increase in the viscosity thereof may be suppressed. In this regard, when the temperature of the outer circumferential surface of the press roll 64B is set, it is estimated that the gloss difference between the first image and the second image may be reduced.

Test 2-4

In order to verify the aforementioned estimation from Test 2-3, Test 2-4 is conducted. In Test 2-4, the roughness of the outer circumferential surface of the oil removing roll 62B constituting the second oil removing unit 50B is 0.9 μm. The roughness of the outer circumferential surface of the press roll 64B constituting the second oil removing unit 50B is 0.9 μm. The roughnesses of the outer circumferential surfaces refer to an arithmetic average surface roughness. In Test 2-4, the temperature of the outer circumferential surface of the oil removing roll 62B is 120° C., and the temperature of the outer circumferential surface of the press roll 64B is 100° C. That is, the temperature of the outer circumferential surface of the press roll 64B is 100° C., and thus, the viscosity of the toners T on the front surface of the medium P is greater than 3000 Pas (see FIG. 9).

The test result of Test 2-4 is as shown in a graph of FIG. 12. As may be seen from the graph of FIG. 12, the gloss difference between the first image and the second image in Position P4 is 2.0, and the gloss difference after fixing is 2.3. The gloss difference (2.0) between the first image and the second image in Position P4 of Test 2-4 (Example 2) (FIG. 12) is smaller than the gloss difference (7.5) between the first image and the second image in Position P4 of Example 1 (FIG. 8). The gloss difference (2.3) between the first image and the second image after fixing of Test 2-4 (Example 2) (FIG. 12) is smaller than the gloss difference (5.2) between the first image and the second image after fixing of Example 1 (FIG. 8). In this regard, since the gloss difference between the first image and the second image in the respective positions of Example 2 is smaller than that of Example 1, it is verified that the gloss difference between the first image and the second image in Example 2 is further reduced than that of Comparative Example 1.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first image forming unit that forms a first image on a front surface of a transported medium with a developer including toners and non-volatile oils;

a removing unit that is disposed on a downstream side of the first image forming unit in a transport direction of the medium, and heats non-volatile oils on the front surface of the medium to remove the oils;

a second image forming unit that is disposed on a downstream side of the removing unit in the transport direction, and forms a second image on a back surface of the medium with a developer including toners and non-volatile oils;

a removing section that is disposed on a downstream side of the second image forming unit in the transport direction of the medium, and heats non-volatile oils on the back surface of the medium to remove the oils; and a fixing unit that is disposed on a downstream side of the removing section in the transport direction, and fixes the first image and the second image on the front surface and the back surface of the medium, wherein the fixing unit applies a heat amount to the medium that is greater than a heat amount in the removing unit and the removing section.

2. The image forming apparatus according to claim 1, further comprising:

a first heating unit that is disposed on a downstream side of the first image forming unit in the transport direction of the medium and an upstream side of the removing unit in the transport direction of the medium, and heats toners on the front surface of the medium.

3. The image forming apparatus according to claim 1, further comprising:

a second heating unit that is disposed on a downstream side of the second image forming unit in the transport direction of the medium and an upstream side of the removing section in the transport direction of the medium, and heats the toners on the back surface of the medium.

4. An image forming apparatus comprising:

a first image forming unit that forms a first image on a front surface of a transported medium with a developer including toners and non-volatile oils;

a removing unit that is disposed on a downstream side of the first image forming unit in a transport direction of the medium, and heats non-volatile oils on the front surface of the medium to remove the oils;

a second image forming unit that is disposed on a downstream side of the removing unit in the transport direction, and forms a second image on a back surface of the medium with a developer including toners and non-volatile oils;

a removing section that is disposed on a downstream side of the second image forming unit in the transport direction of the medium, and heats non-volatile oils on the back surface of the medium to remove the oils;

a fixing unit that is disposed on a downstream side of the removing section in the transport direction, and fixes the first image and the second image on the front surface and the back surface of the medium; and a reducing section that is disposed on a downstream side of the first image forming unit in the transport direction of the medium and an upstream side of the fixing unit in the transport direction of the medium, and reduces an increase in gloss of the first image after fixing, wherein the removing section includes a first contact member that comes in contact with the back surface of the medium, and the reducing section includes a second contact member that has a coarser surface than the first contact member and comes in contact with the front surface of the medium.

5. The image forming apparatus according to claim 4, wherein a portion of the first contact member which comes in contact with the back surface of the medium in the removing section is formed as an elastic member, and the removing section includes a heating section that heats the first contact member.

6. The image forming apparatus according to claim 4, wherein a portion of the first contact member which comes in contact with the back surface of the medium in the removing section is made from a metal, and the removing section includes a heating section that heats the first contact member.

7. The image forming apparatus according to claim 4, wherein the removing section includes a first contact member that comes in contact with the back surface of the medium, and the reducing section includes a second contact member that comes in contact with the front surface of the medium at a temperature lower than a temperature of the first contact member.

8. The image forming apparatus according to claim 5,
wherein the removing section includes a first contact member that comes in contact with the back surface of the medium, and
the reducing section includes a second contact member that comes in contact with the front surface of the medium at a temperature lower than a temperature of the first contact member.

9. An image forming apparatus comprising:
a first image forming unit that forms a first image on a front surface of a transported medium with a developer including toners and non-volatile oils;
a first removing unit that is disposed on a downstream side of the first image forming unit in a transport direction of the medium, and heats non-volatile oils on the front surface of the medium to remove the oils;
a second image forming unit that is disposed on a downstream side of the first removing unit in the transport direction, and forms a second image on a back surface of the medium with a developer including toners and non-volatile oils;
a fixing unit that is disposed on a downstream side of the second image forming unit in the transport direction, and fixes the first image and the second image on the front surface and the back surface of the medium; and
a second removing unit that is disposed on a downstream side of the second image forming unit in the transport direction of the medium and an upstream side of the fixing unit in the transport direction of the medium, and includes a removing section which heats non-volatile oils on the back surface of the medium to remove the oils and a reducing section which reduces an increase in gloss of the first image after fixing,
wherein the removing section includes a first contact member that comes in contact with the back surface of the medium, and
the reducing section includes a second contact member that has a coarser surface than the first contact member and comes in contact with the front surface of the medium.

10. The image forming apparatus according to claim 9,
wherein a portion of the first contact member which comes in contact with the back surface of the medium in the removing section is formed as an elastic member, and
the removing section includes a heating section that heats the first contact member.

11. The image forming apparatus according to claim 9,
wherein a portion of the first contact member which comes in contact with the back surface of the medium in the removing section is made from a metal, and
the removing section includes a heating section that heats the first contact member.

12. The image forming apparatus according to claim 9,
wherein the removing section includes a first contact member that comes in contact with the back surface of the medium, and
the reducing section includes a second contact member that comes in contact with the front surface of the medium at a temperature lower than a temperature of the first contact member.

13. An image forming apparatus comprising:
a first image forming unit that forms a first image on a front surface of a transported medium with a developer including toners and non-volatile oils;
a removing unit that is disposed on a downstream side of the first image forming unit in a transport direction of the medium, and heats non-volatile oils on the front surface of the medium to remove the oils;
a second image forming unit that is disposed on a downstream side of the removing unit in the transport direction, and forms a second image on a back surface of the medium with a developer including toners and non-volatile oils;
a removing section that is disposed on a downstream side of the second image forming unit in the transport direction of the medium, and heats non-volatile oils on the back surface of the medium to remove the oils;
a fixing unit that is disposed on a downstream side of the removing section in the transport direction, and fixes the first image and the second image on the front surface and the back surface of the medium; and
a reducing section that is disposed on a downstream side of the first image forming unit in the transport direction of the medium and an upstream side of the fixing unit in the transport direction of the medium, and reduces an increase in gloss of the first image after fixing,
wherein the removing section includes a first contact member that comes in contact with the back surface of the medium,
the reducing section includes a second contact member that has a coarser surface than the first contact member and comes in contact with the front surface of the medium, and
the second contact member constitutes the removing unit.

14. The image forming apparatus according to claim 13,
wherein a portion of the first contact member which comes in contact with the back surface of the medium in the removing section is formed as an elastic member, and
the removing section includes a heating section that heats the first contact member.

15. The image forming apparatus according to claim 13,
wherein a portion of the first contact member which comes in contact with the back surface of the medium in the removing section is made from a metal, and
the removing section includes a heating section that heats the first contact member.

16. The image forming apparatus according to claim 13,
wherein the removing section includes a first contact member that comes in contact with the back surface of the medium, and
the reducing section includes a second contact member that comes in contact with the front surface of the medium at a temperature lower than a temperature of the first contact member.

17. An image forming apparatus comprising:
a first image forming unit that forms a first image on a front surface of a transported medium with a developer including toners and non-volatile oils;
a removing unit that is disposed on a downstream side of the first image forming unit in a transport direction of the medium, and heats non-volatile oils on the front surface of the medium to remove the oils;
a second image forming unit that is disposed on a downstream side of the removing unit in the transport direction, and forms a second image on a back surface of the medium with a developer including toners and non-volatile oils;
a removing section that is disposed on a downstream side of the second image forming unit in the transport direction of the medium, and heats non-volatile oils on the back surface of the medium to remove the oils;
a fixing unit that is disposed on a downstream side of the removing section in the transport direction, and fixes the first image and the second image on the front surface and the back surface of the medium; and a reducing section that is disposed on a downstream side of the first image forming unit in the transport direction of the medium and an upstream side of the fixing unit in the transport direction of the medium, and reduces an increase in gloss of the first image.

18. An image forming apparatus comprising:

a first image forming unit that forms a first image on a front surface of a transported medium with a developer including toners and non-volatile oils;

a first removing unit that is disposed on a downstream side of the first image forming unit in a transport direction of the medium, and heats non-volatile oils on the front surface of the medium to remove the oils;

a second image forming unit that is disposed on a downstream side of the first removing unit in the transport direction, and forms a second image on a back surface of the medium with a developer including toners and non-volatile oils;

a fixing unit that is disposed on a downstream side of the second image forming unit in the transport direction, and fixes the first image and the second image on the front surface and the back surface of the medium; and a second removing unit that is disposed on a downstream side of the second image forming unit in the transport direction of the medium and an upstream side of the fixing unit in the transport direction of the medium, and includes a removing section which heats non-volatile oils on the back surface of the medium to remove the oils and a reducing section which reduces an increase in gloss of the first image.

19. An image forming apparatus comprising:

a first image forming unit that forms a first image on a front surface of a transported medium with a developer including toners and non-volatile oils;

a removing unit that is disposed on a downstream side of the first image forming unit in a transport direction of the medium, and heats non-volatile oils on the front surface of the medium to remove the oils;

a second image forming unit that is disposed on a downstream side of the removing unit in the transport direction, and forms a second image on a back surface of the medium with a developer including toners and non-volatile oils;

a removing section that is disposed on a downstream side of the second image forming unit in the transport direction of the medium, and heats non-volatile oils on the back surface of the medium to remove the oils;

a fixing unit that is disposed on a downstream side of the removing section in the transport direction, and fixes the first image and the second image on the front surface and the back surface of the medium; and a reducing section that is disposed on a downstream side of the first image forming unit in the transport direction of the medium and an upstream side of the fixing unit in the transport direction of the medium, and reduces an increase in gloss of the first image after fixing, wherein the removing section includes a first contact member that comes in contact with the back surface of the medium, and the reducing section includes a second contact member that comes in contact with the front surface of the medium at a temperature lower than a temperature of the first contact member.

20. An image forming apparatus comprising:

a first image forming unit that forms a first image on a front surface of a transported medium with a developer including toners and non-volatile oils;

a first removing unit that is disposed on a downstream side of the first image forming unit in a transport direction of the medium, and heats non-volatile oils on the front surface of the medium to remove the oils:

a second image forming unit that is disposed on a downstream side of the first removing unit in the transport direction, and forms a second image on a back surface of the medium with a developer including toners and non-volatile oils;

a fixing unit that is disposed on a downstream side of the second image forming unit in the transport direction and fixes the first image and the second image on the front surface and the back surface of the medium; and a second removing unit that is disposed on a downstream side of the second image forming unit in the transport direction of the medium and an upstream side of the fixing unit in the transport direction of the medium, and includes a removing section which heats non-volatile oils on the back surface of the medium to remove the oils and a reducing section which reduces an increase in gloss of the first image after fixing, wherein the removing section includes a first contact member that comes in contact with the back surface of the medium, and the reducing section includes a second contact member that comes in contact with the front surface of the medium at a temperature lower than a temperature of the first contact member.

* * * * *